US010974509B2

(12) United States Patent
Hagiwara et al.

(10) Patent No.: US 10,974,509 B2
(45) Date of Patent: Apr. 13, 2021

(54) LIQUID EJECTING HEAD UNIT, LIQUID EJECTING HEAD MODULE, AND LIQUID EJECTING APPARATUS

(71) Applicant: SEIKO EPSON CORPORATION, Tokyo (JP)

(72) Inventors: Hiroyuki Hagiwara, Matsumoto (JP); Katsuhiro Okubo, Azumino (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/584,259

(22) Filed: Sep. 26, 2019

(65) Prior Publication Data

US 2020/0101734 A1 Apr. 2, 2020

(30) Foreign Application Priority Data

Sep. 28, 2018 (JP) ..... JP2018-183522

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
None
See application file for complete search history.

(56) References Cited

U.S. PATENT DOCUMENTS 6,398,329 B1 * 6/2002 Boyd ..... B41J 2/14153 347/7
2007/0252860 A1 * 11/2007 Nitta ..... B41J 2/17596 347/14
2014/0104348 A1 * 4/2014 Owaki ..... B41J 2/17596 347/85
2017/0096004 A1 * 4/2017 Dowell ..... B41J 2/155
2017/0217169 A1 8/2017 Kanegae et al.

FOREIGN PATENT DOCUMENTS

JP 2017-136721 A 8/2017

* cited by examiner

*Primary Examiner* — Erica S Lin
(74) *Attorney, Agent, or Firm* — Workman Nydegger

(57) ABSTRACT

A liquid ejecting head unit including: an ejection surface including nozzles being arranged in a first-direction; and a flow-path-member including a flow path communicating with the nozzles, wherein the ejection surface has a planar shape including a first-portion and a second-portion, the first-portion and the second-portion are arranged in the first-direction with respect to each other, the first-portion spans across a center-line of a rectangle having a minimum area that surrounds the ejection surface, the center-line extending parallel to the first-direction, the second-portion is located adjacent to the first-portion in the first-direction and shifted away from the center-line in a second-direction that substantially perpendicular to the first-direction, the flow-path-member includes first-connecting ports, at least one of the first-connecting ports communicating with the flow path, and the first-connecting ports overlap the second-portion in plan view of the ejection surface and are shifted away from each other in the first-direction.

20 Claims, 15 Drawing Sheets

LIQUID EJECTING HEAD UNIT, LIQUID EJECTING HEAD MODULE, AND LIQUID EJECTING APPARATUS

The present application is based on, and claims priority from JP Application Serial Number 2018-183522, filed Sep. 28, 2018, the disclosure of which is hereby incorporated by reference herein in its entirety.

BACKGROUND

1. Technical Field

The present disclosure relates to liquid ejecting head units, liquid ejecting head modules, and liquid ejecting apparatuses, and more specifically relates to ink jet recording head units for ejecting ink as a liquid, ink jet recording head modules, and ink jet recording apparatuses.

2. Related Art

Representative examples of the liquid ejecting head unit include an ink jet recording head unit configured to eject ink. The ink jet recording head unit includes a plurality of ink jet recording heads configured to eject ink. Further, there have been known ink jet head modules in which a plurality of ink jet head units are arranged in parallel. The ink jet head module has a distribution flow path for distributing ink to the respective ink jet recording head units. JP-A-2017-136721 is an example of the related art.

The distribution flow path, which is common to the plurality of ink jet head units, is disposed on the side surface of the ink jet head units. Since the ink jet head unit has a width substantially including the distribution flow path, the size of the ink jet head unit in the width direction vertical to the side surface is increased. When the plurality of ink jet head units are arranged in parallel in the width direction, the ink jet head module is accordingly increased in size due to the distribution flow path provided therein. As a matter of course, the ink jet recording apparatus including the ink jet head module is accordingly increased in size in the width direction.

These issues occur not only for the ink jet recording head units, the ink jet recording head modules, and the ink jet recording apparatuses, but also for the liquid ejecting head units that eject liquid other than ink, the liquid ejecting head modules, and the liquid ejecting apparatuses.

SUMMARY

According to an aspect of the present disclosure, a liquid ejecting head unit that is reduced in size, a liquid ejecting head module, and a liquid ejecting apparatus are provided.

An aspect of the present disclosure is a liquid ejecting head unit including: an ejection surface on which a plurality of nozzles for ejecting liquid are arranged in parallel in one direction; and a flow path member in which a flow path for supplying liquid to the nozzles is formed, wherein the ejection surface has a planar shape including a first portion and a second portion arranged in a direction along a long side of a rectangle having a minimum area which includes the ejection surface, the first portion being configured such that a center line extending parallel to the long side of the rectangle passes therethrough, and the second portion being configured such that the center line does not passes therethrough, the flow path member includes a plurality of connecting portions disposed in a portion overlapping the second portion in plan view of the ejection surface, the connecting portions communicating with the flow path and connecting to an external liquid storage unit, and the plurality of connecting portions are positioned displaced in the one direction. In this aspect, the connecting portions are disposed in a portion of the flow path member which overlaps the second portion, and the connecting portions are positioned displaced in the one direction. With this arrangement of the connecting portions, a width of the liquid ejecting head unit in the one direction can be reduced and thus the liquid ejecting head unit can be reduced in size.

Further, the shape of the ejection surface may include a third portion disposed on a side of the first portion opposite to that facing the second portion, the third portion being configured such that the center line does not passes therethrough. Accordingly, since the connecting portions can be positioned spaced from each other between the second portion and the third portion, a distance between the connecting portions can be ensured, and thus work efficiency in attaching the tubes for supplying liquid to the connecting portions is improved.

Further, the second portion and the third portion may be positioned with the center line interposed therebetween. Accordingly, a space between the liquid ejecting head units aligned in the one direction can be narrowed.

Further, the flow path member may include the plurality of connecting portions disposed in a portion overlapping the third portion in plan view of the ejection surface, the connecting portions being positioned displaced in the one direction. Accordingly, since the connecting portions can also be positioned in the portion overlapping the third portion of the flow path member, a distance between the connecting portions can be ensured compared with a configuration in which the connecting portions are disposed only in the portion overlapping the second portion. Therefore, work efficiency in attaching the tubes for supplying liquid to the connecting portions is further improved.

Further, a height of the connecting portion disposed in a portion overlapping the second portion of the flow path member and a height of the connecting portion disposed in a portion overlapping the third portion of the flow path member in a direction perpendicular to the ejection surface may be different from each other. With this configuration, errors in connection of the tubes to the connecting portions can be easily prevented from occurring.

Further, the flow path member may include a supply flow path for supplying liquid to the nozzles and a discharge flow path for discharging liquid that is not ejected from the nozzles, the connecting portion may correspond to a supply port communicating with the supply flow path and a discharge port communicating with the discharge flow path, and the supply port may be provided in a portion overlapping one of the second portion and the third portion of the flow path member, and the discharge port may be provided in a portion overlapping the other. With this configuration, errors in connection of the tubes to the connecting portions can be more easily prevented from occurring.

Further, a connector may be provided in a portion overlapping the first portion of the flow path member, the connector being connected to a wiring for transmitting and receiving a signal to and from an external control unit, and at least part of the connecting portion may be located farther from the ejection surface in a direction perpendicular to the ejection surface than the connector is located. With this configuration, errors in connection of the tubes to the connecting portions can be more easily prevented from occurring.

Further, a connector may be provided in a portion overlapping the first portion of the flow path member, the connector being connected to a wiring for transmitting and receiving a signal to and from an external control unit, and the connecting portion may be located closer to the ejection surface in a direction perpendicular to the ejection surface than the connector is located. Accordingly, the connector can be prevented from being exposed to liquid even if liquid leakage from the connecting portions occurs, and thus a failure such as short circuit of the electrical components due to liquid leakage can be reduced.

Further, a portion of the flow path member in which the connecting portion is provided may be located closer to the ejection surface in a direction perpendicular to the ejection surface than a portion of the flow path member in which the connector is provided is located. Accordingly, the connector can be prevented from being exposed to liquid even if liquid leakage from the connecting portions occurs, and thus a failure such as short circuit of the electrical components due to liquid leakage can be reduced.

Further, the plurality of connecting portions may be positioned displaced in the one direction. Accordingly, the liquid ejecting head unit can be further reduced in size.

Further, among the plurality of connecting portions, the connecting portion located closer to the first portion in the one direction may have a greater height in a direction perpendicular to the ejection surface. Accordingly, attachment and detachment of the tubes to and from the connecting portions are facilitated.

Further, a head fixation portion fixed to an external support body may be provided, wherein the head fixation portion may be located closer to the ejection surface in a direction perpendicular to the ejection surface than the connecting portion is located. Accordingly, while the liquid ejecting head unit is mounted on the support body, attachment of the tubes to the connecting portions is facilitated.

Further, the head fixation portion may be disposed on an outside in the one direction. Accordingly, the liquid ejecting head unit can be further reduced in size.

Further, the flow path member may include a supply flow path for supplying liquid to the nozzles and a discharge flow path for discharging liquid that is not ejected from the nozzles, and the connecting portion may correspond to a supply port communicating with the supply flow path and a discharge port communicating with the discharge flow path. Even in the configuration having the supply port and the discharge port, the ports are displaced in the one direction. Accordingly, the liquid ejecting head unit can be reduced in size.

Further, a diameter of the discharge port may be larger than a diameter of the supply port. With this configuration, errors in connection of the tubes to the connecting portions can be more easily prevented from occurring.

Another aspect of the disclosure is a liquid ejecting head module including the aforementioned liquid ejecting head unit.

According to this aspect of the disclosure, a liquid ejecting module that can be reduced in size is provided.

Further, the liquid ejecting head module may include at least two of the liquid ejecting head units arranged in parallel in the one direction, and the connecting portion of one of the liquid ejecting head units and the connecting portion of the other of the liquid ejecting head units may be displaced in the one direction. With this configuration, a distance between the connecting portions of the liquid ejecting head units can be ensured. Accordingly, attachment and detachment of the tubes to and from the connecting portions are facilitated.

Further, the liquid ejecting head module may include a plurality of the liquid ejecting head units arranged in parallel in the one direction, and the connecting portions of the plurality of liquid ejecting head units may be arranged in the one direction. With this configuration, the tubes can be neatly arranged without being mixed, and thus work efficiency in attachment and detachment of the tubes to the connecting portions is improved.

Still another aspect of the disclosure is a liquid ejecting apparatus including the aforementioned liquid ejecting head module. According to this aspect of the disclosure, a liquid ejecting apparatus that can be reduced in size is provided.

DESCRIPTION OF EXEMPLARY EMBODIMENTS

Figure 1:
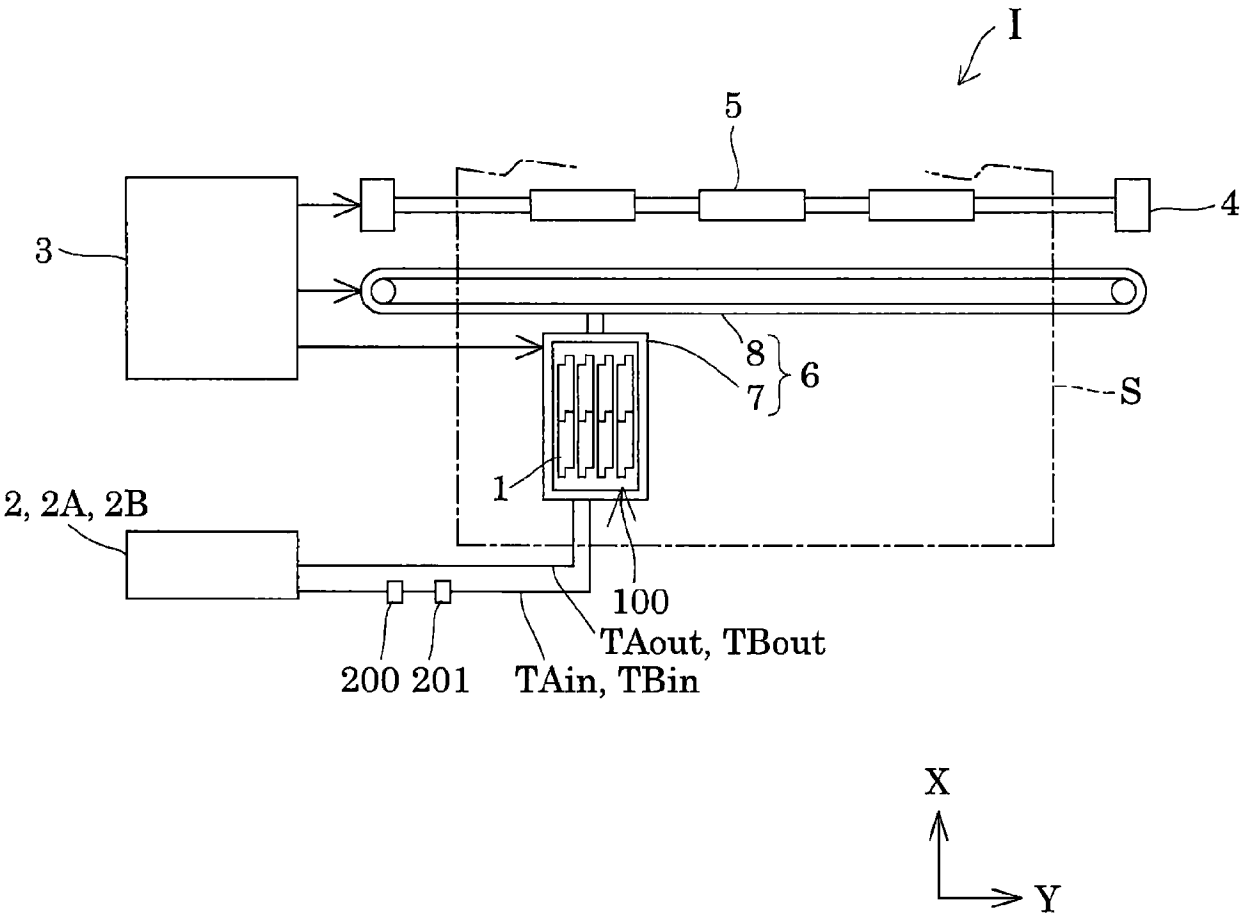
FIG. 1 is a plan view showing a schematic configuration of an ink jet recording apparatus.

Embodiments of the disclosure will now be described in detail. The following description is a mere aspect of the disclosure, and various modifications can be made within the scope of the disclosure. Throughout the drawings, the same reference numbers denote the same components, and the description thereof is omitted as appropriate. Moreover, X, Y, and Z in the drawings respectively represent three space axes that are perpendicular to each other. In this specification, the directions along these axes are each described as X, Y, and Z directions. The direction of the arrow in the drawings is described as the positive (+) direction, and the direction opposite to the arrow is described as the negative (−) direction. Furthermore, the third direction Z indicates the vertical direction. The +Z direction indicates the vertically downward direction, and the −Z direction indicates the vertically upward direction.

Embodiment 1

An example of the liquid ejecting apparatus is shown as an ink jet recording apparatus (hereinafter, a recording apparatus) I. An example of the liquid ejecting head module is shown as an ink jet head module (hereinafter, a head module) 100. An example of the liquid ejecting head unit is shown as an ink jet head unit (hereinafter, a head unit) 1.

FIG. 1 is a plan view of the recording apparatus according to the present embodiment. The recording apparatus I is an apparatus configured to eject ink, which is liquid, onto a medium S. Examples of the medium S for use with the recording apparatus I include paper, resin film, cloth, and the like.

A liquid container 2 that stores ink is fixed to the recording apparatus I. Examples of the liquid container 2 include a cartridge detachably attached to the recording apparatus I, a bag-shaped ink pack made of a flexible film, and an ink tank that can be refilled with ink. Further, although not shown in the figure, the liquid container 2 stores different colors or different types of ink. The liquid container 2 is an example of a liquid storage unit.

Further, the recording apparatus I includes a control unit 3, which is a controller, a transport mechanism 4, and the head module 100.

Although not shown in the figure, the control unit 3 includes, for example, a controller such as CPU (central processing unit) or FPGA (field programmable gate array) and a storage unit such as a semiconductor memory, and is configured such that the controller executes programs stored in the storage unit to thereby integrally control the components in the recording apparatus I.

The transport mechanism 4 is controlled by the control unit 3 to transports the medium S in the X direction, and includes, for example, a transport roller 5.

Furthermore, the transport mechanism for transporting the medium S is not limited to the transport roller 5, and the medium S can also be transported by using a belt or drum.

A movement mechanism 6 is controlled by the control unit 3 to reciprocate the head module 100 in the Y direction. The Y direction, in which the head module 100 is reciprocated by the movement mechanism 6, is a direction perpendicular to the X direction, which is a transport direction of the medium S.

Specifically, the movement mechanism 6 of the present embodiment includes a transport body 7 and a transport belt 8. The transport body 7 is a substantially box-shaped structure that supports the head module 100, that is, a carriage, and is fixed to the transport belt 8. The transport belt 8 is an endless belt extending in the Y direction. As the transport belt 8 rotates under the control of the control unit 3, the head module 100 reciprocates in the Y direction together with the transport body 7. Moreover, the liquid container 2 together with the head module 100 may also be mounted on the transport body 7.

In the present embodiment, eight liquid containers 2 are provided (in the figure, one liquid container 2 is collectively shown), and ink is supplied from two liquid containers 2 to one head unit 1. The two liquid containers corresponding to one head unit 1 are referred to as a liquid container 2A and a liquid container 2B. The liquid container 2A is connected to a supply tube TAin and a discharge tube TAout. The liquid container 2B is connected to a supply tube TBin and a discharge tube TBout. The supply tube TAin and the supply tube TBin may also be collectively referred to as a supply tube. The discharge tube TAout and the discharge tube TBout may also be collectively referred to as a discharge tube. Moreover, the supply tube and the discharge tube may also be collectively referred to as a tube.

The supply tube TAin and the supply tube TBin are tubes for supplying ink in the liquid container 2A and the liquid container 2B pressurized to a predetermined pressure by a pump 200 and heated to a predetermined temperature by a heater 201 into the head module 100. The discharge tube TAout and the discharge tube TBout are tubes for discharging ink discharged from the head module 100 into the liquid container 2A and the liquid container 2B.

Thus, the liquid container 2A, the liquid container 2B, and the tubes described above are provided for each head unit 1.

The head module 100 ejects the ink supplied from the liquid container 2 as ink droplets, which are liquid droplets, onto the medium S under the control of the control unit 3. Further, ejection of ink droplets from the head module 100 is performed toward the positive side in the Z direction. When the medium S is transported in the X direction by the transport mechanism 4 while the head module 100 is transported in the Y direction by the moving mechanism 6, the head module 100 ejects ink droplets onto the medium S to thereby form a desired image on the medium S.

Figure 2:
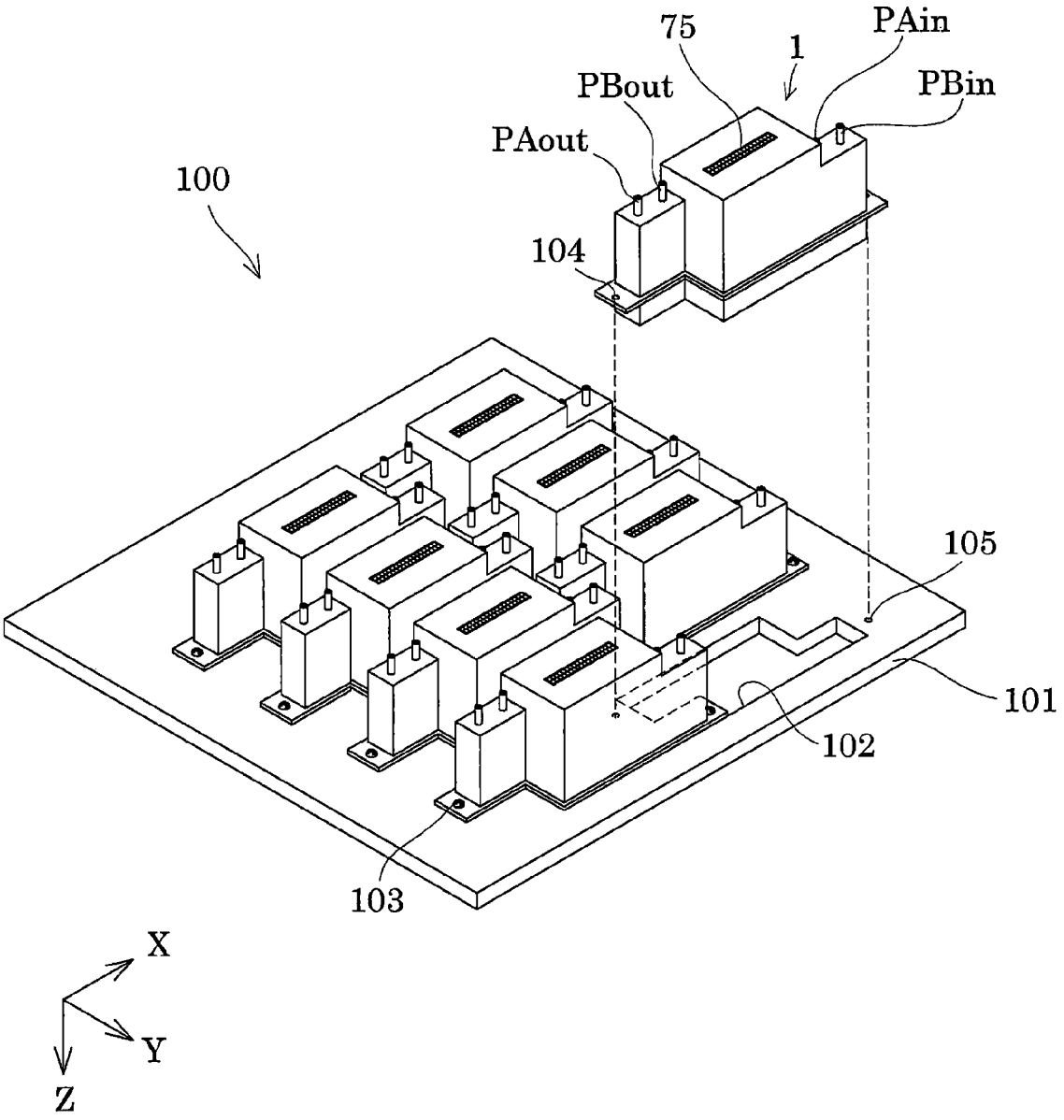
FIG. 2 is an exploded perspective view of a head module.
Figure 3:
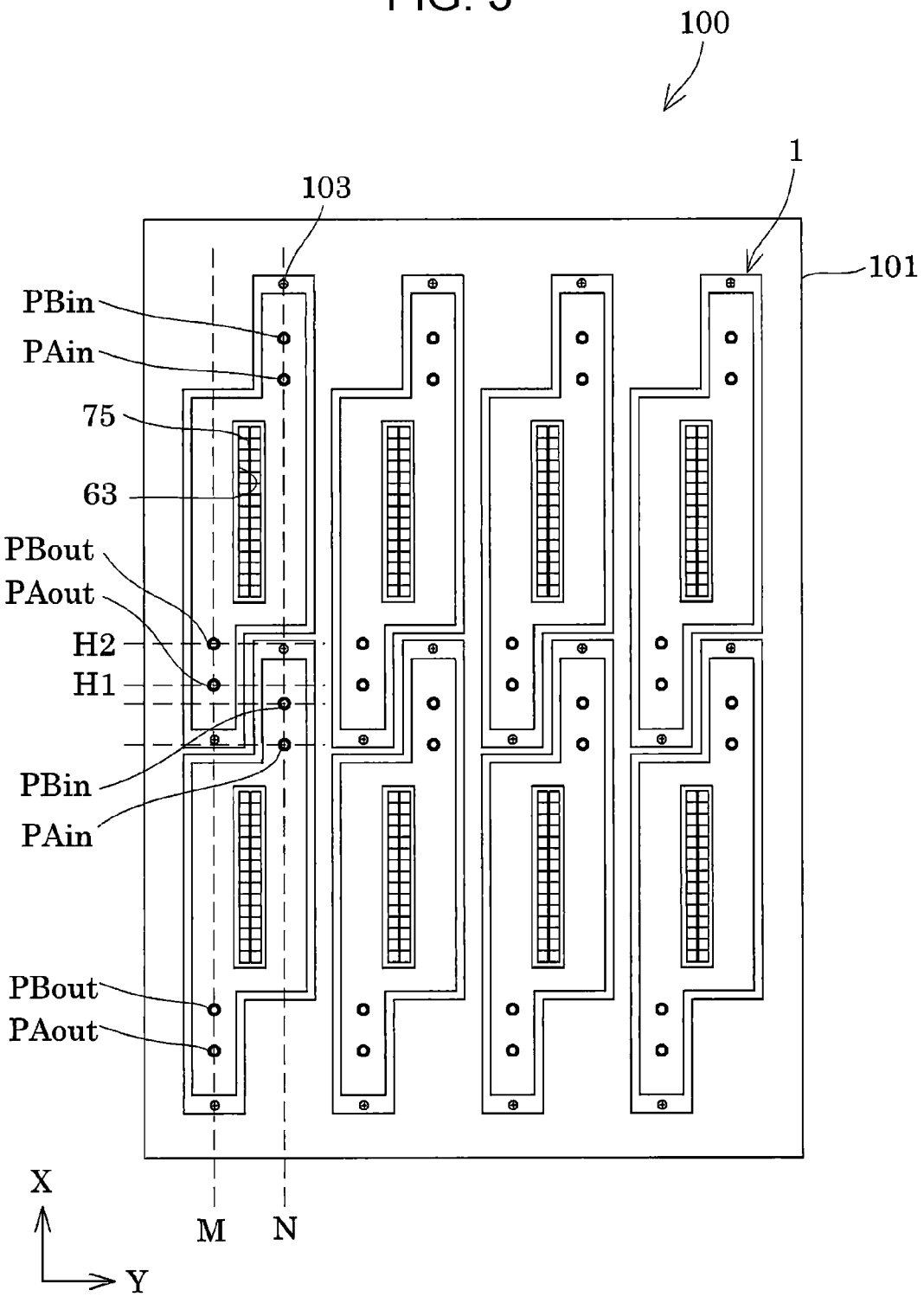
FIG. 3 is a plan view of the head module.

Referring to FIGS. 2 and 3, the head module 100 will be further detailed below. FIG. 2 is an exploded perspective view of the head module according to the present embodiment. FIG. 3 is a plan view of the head module.

The head module 100 includes a support body 101 and a plurality of head units 1. The support body 101 is a plate-shaped member that supports the plurality of head units 1. The support body 101 has support openings 102 for holding the respective head units 1. In the present embodiment, the support openings 102 are independently formed for each of the head units 1. Alternatively, the support opening 102 may also be formed to be continuous over the plurality of head units 1.

The head unit 1 is inserted into the support opening 102 such that a flange 35 (described later) of the head unit 1 is supported by the periphery of the support opening 102. A circulation head 44 (see FIG. 7) of the head unit 1 protrudes from the surface on the +Z-axis side of the support body 101.

Each head unit 1 has fixation ports 104 formed on both ends thereof in the X direction. The support body 101 has screw holes 105 for fixing the head units 1. Each head unit 1 is fixed to the support body 101 by a screw 103 inserted into the fixation port 104 and screwed to screw hole 105.

In the present embodiment, eight head units 1, two in the X direction and four in the Y direction, are fixed to the support body 101. The respective head units 1 are arranged such that nozzles, described later, are arranged in parallel in the X direction (corresponding to "one direction" recited in the claims). The detailed arrangement of the head unit 1 will be described later.

Figure 4:
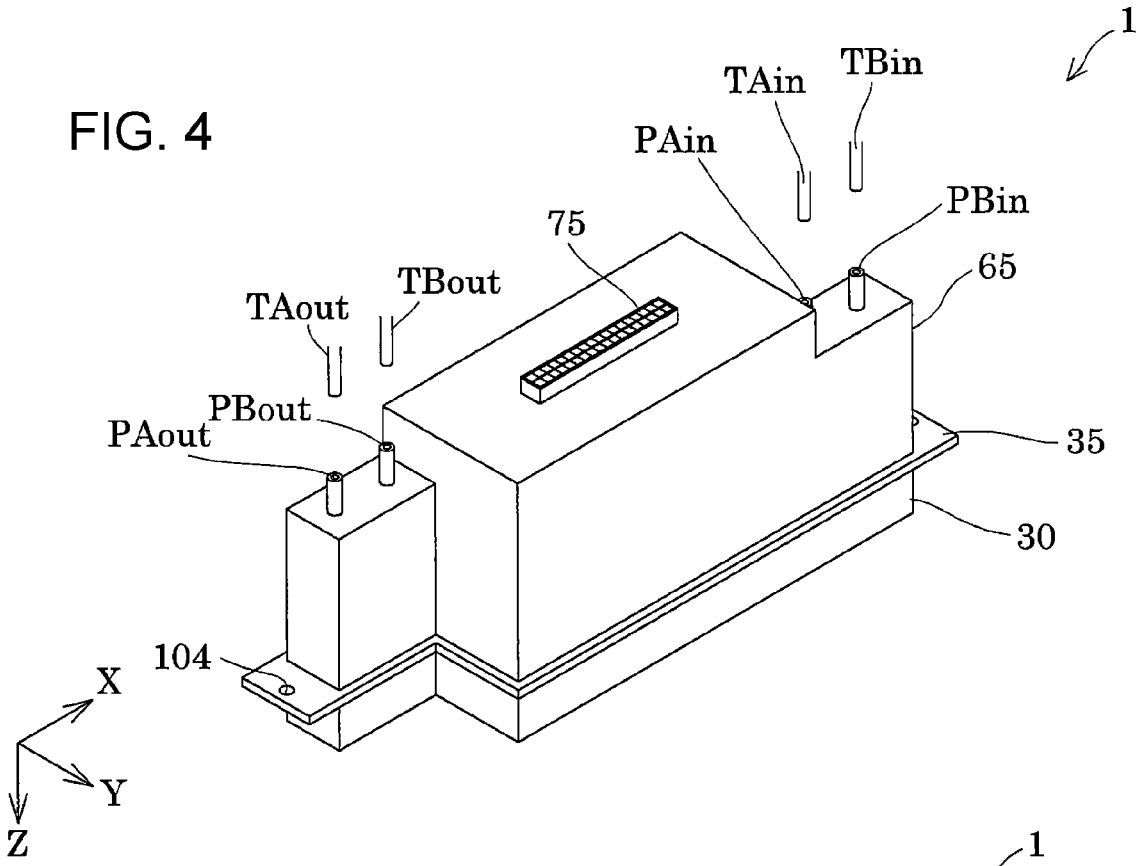
FIG. 4 is a perspective view of a head unit.
Figure 5:
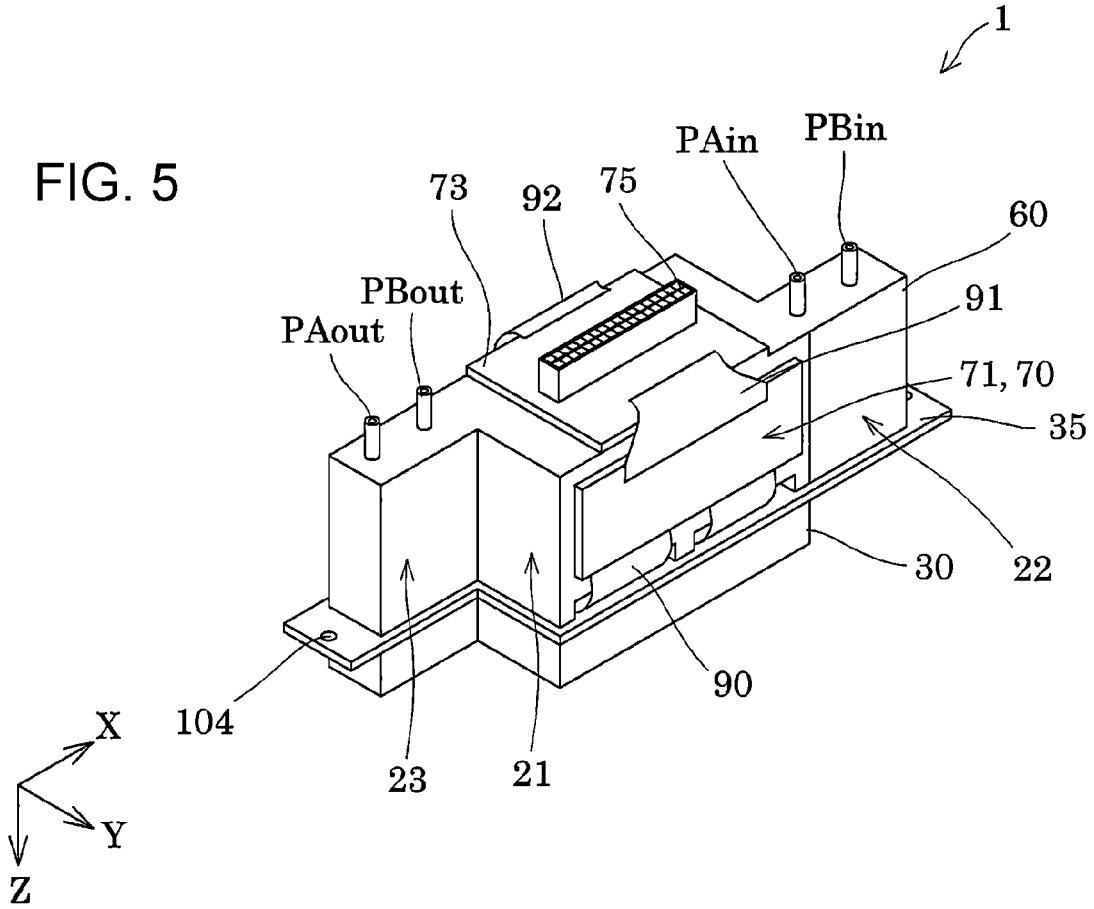
FIG. 5 is a perspective view showing an inside of the head unit.
Figure 6:
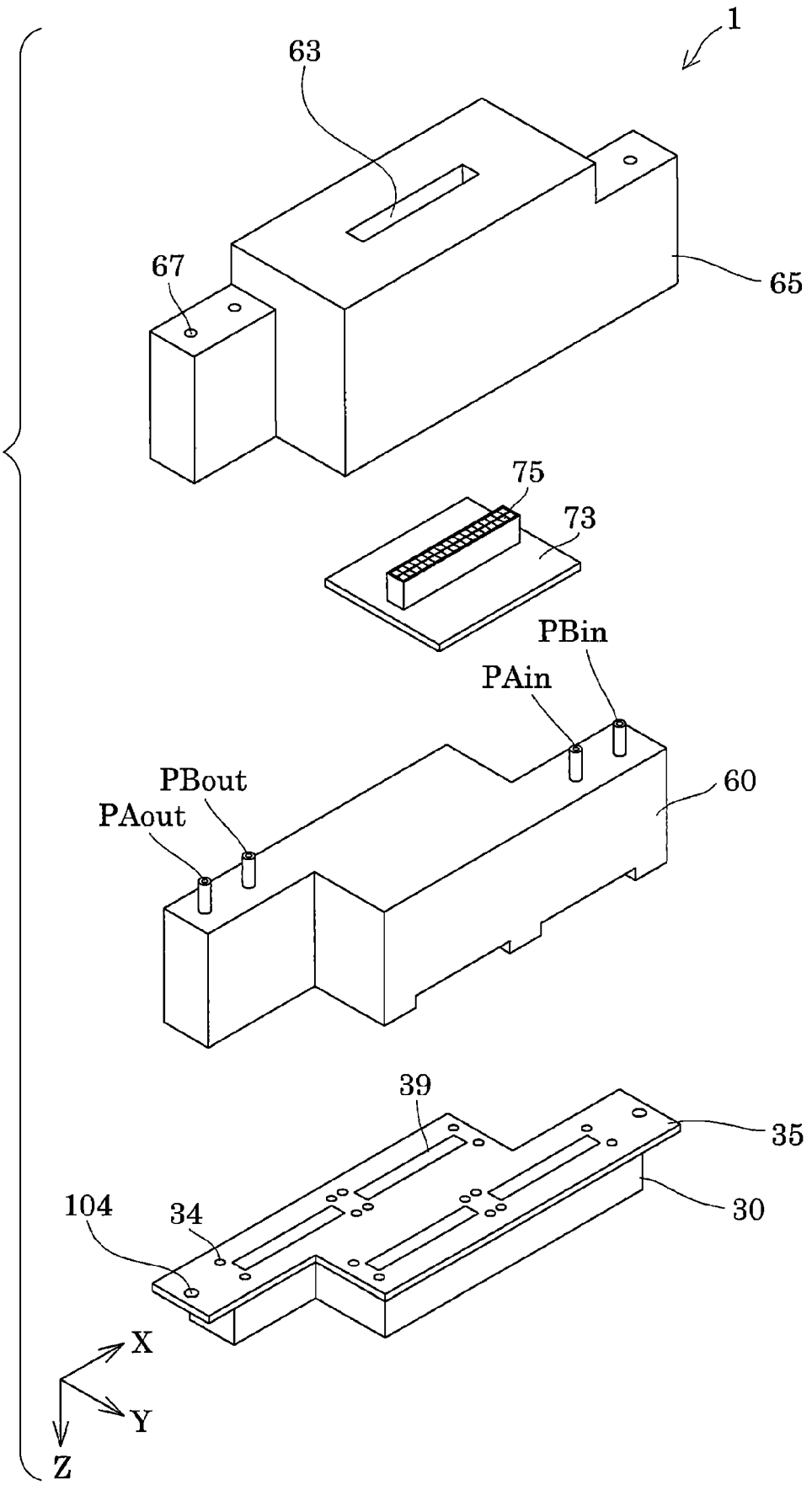
FIG. 6 is an exploded perspective view of an upper part (−Z-axis side) of the head unit.
Figure 7:
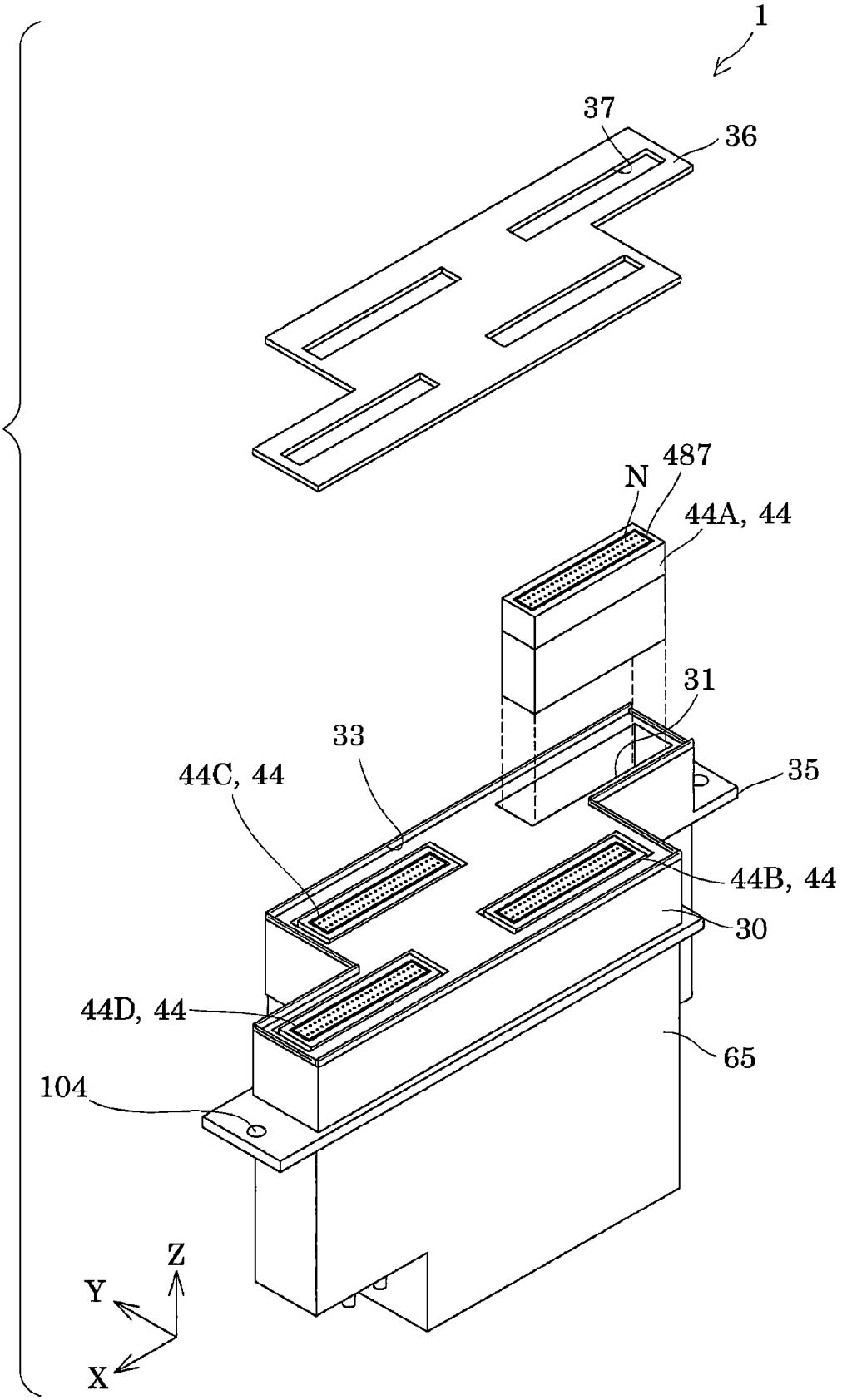
FIG. 7 is an exploded perspective view of a lower part (+Z-axis side) of the head unit.
Figure 8:
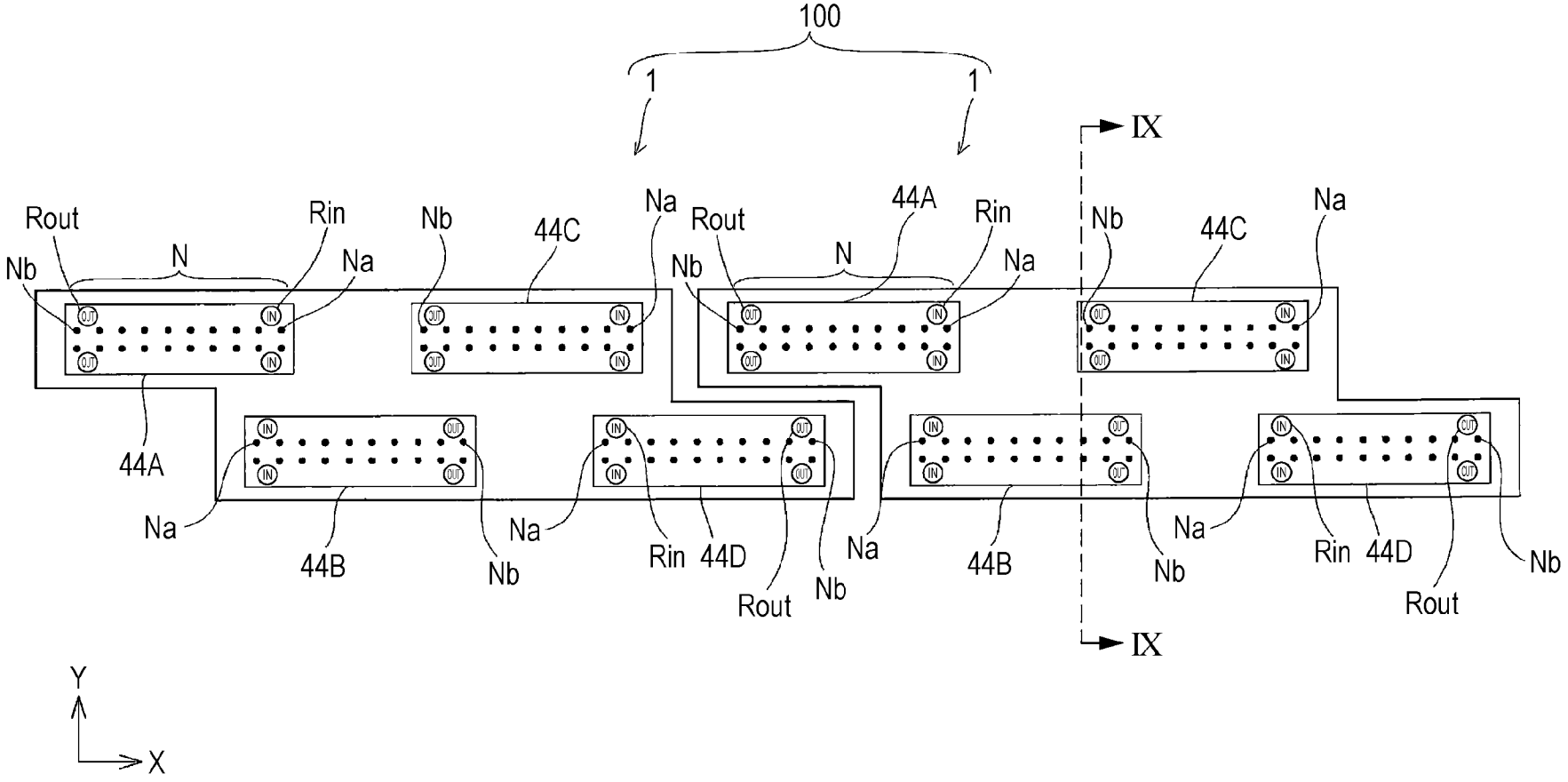
FIG. 8 is a plan view of a circulation head provided in the head module as viewed from the −Z-axis side.
Figure 9:
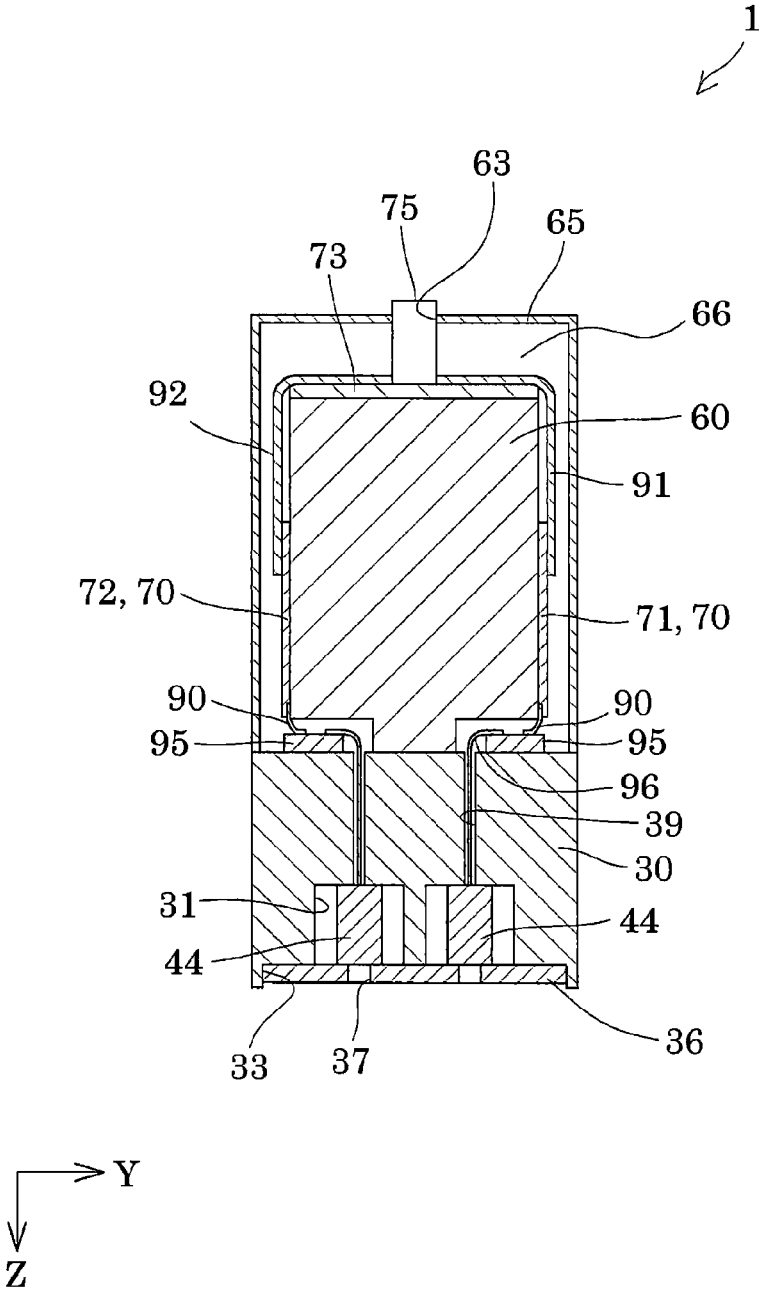
FIG. 9 is a cross-sectional view taken along the line IX-IX of FIG. 8.
Figure 10:
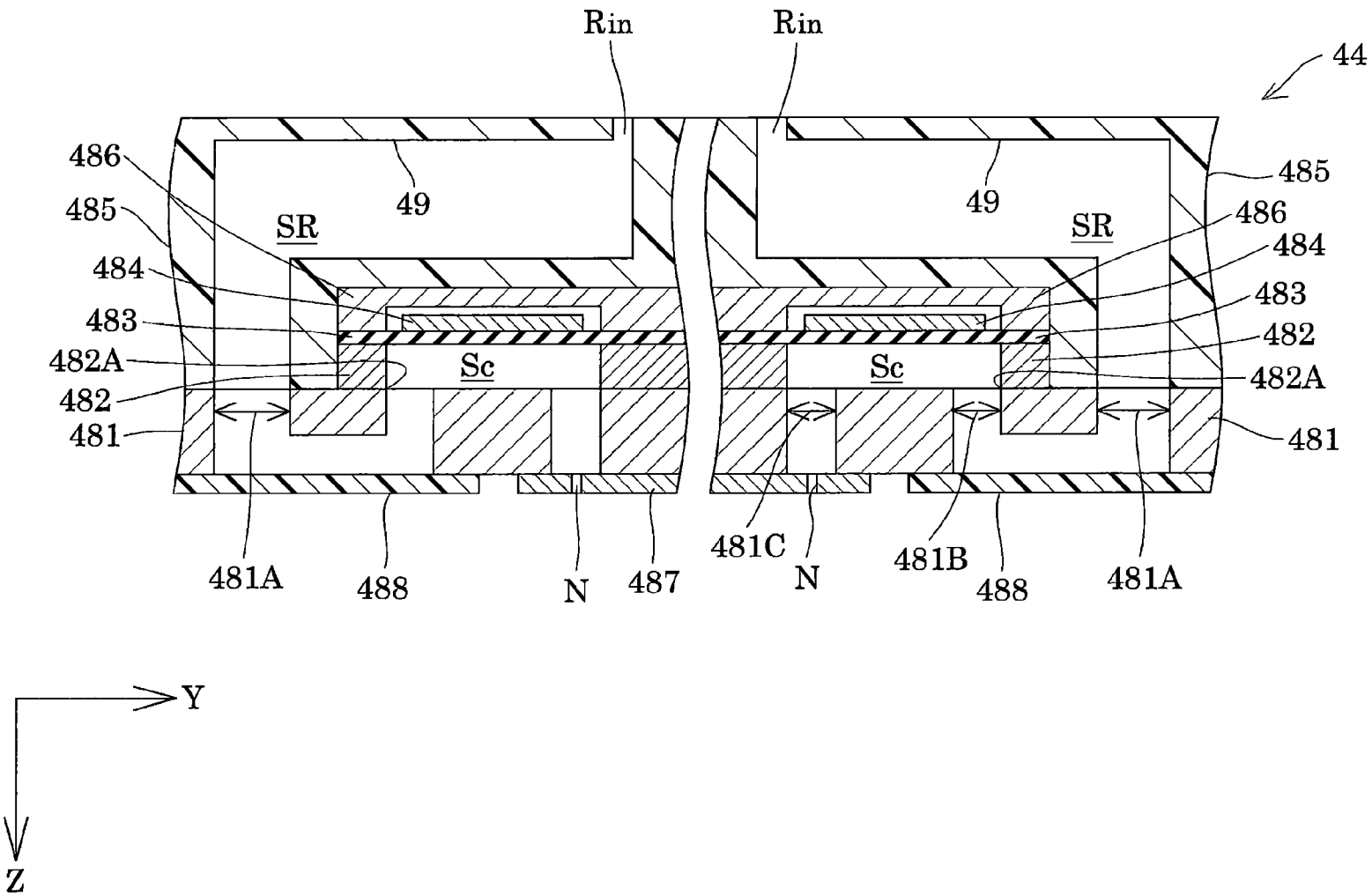
FIG. 10 is a cross-sectional view of the circulation head.
Figure 11:
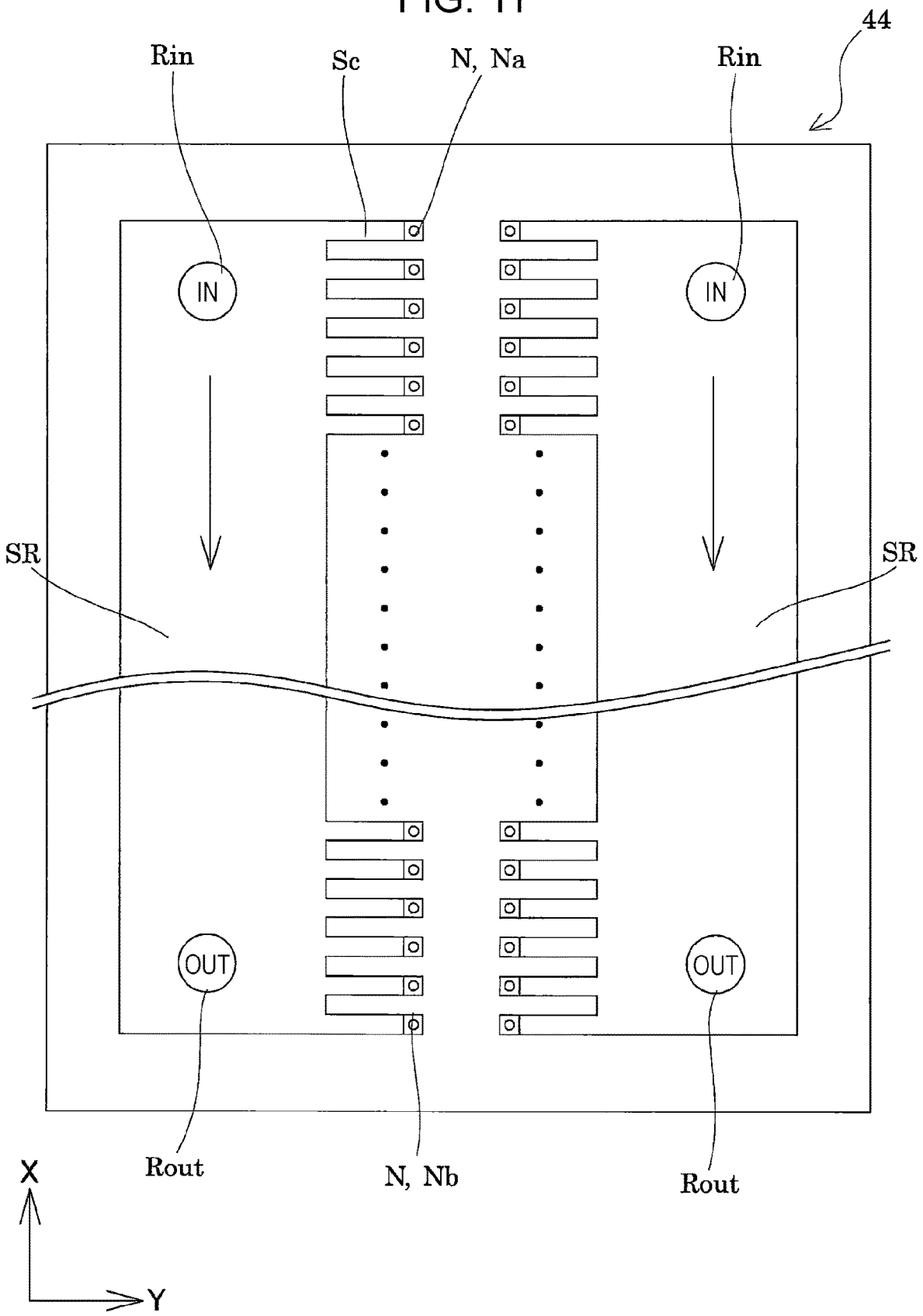
FIG. 11 is a plan view of the circulation head.
Figure 12:
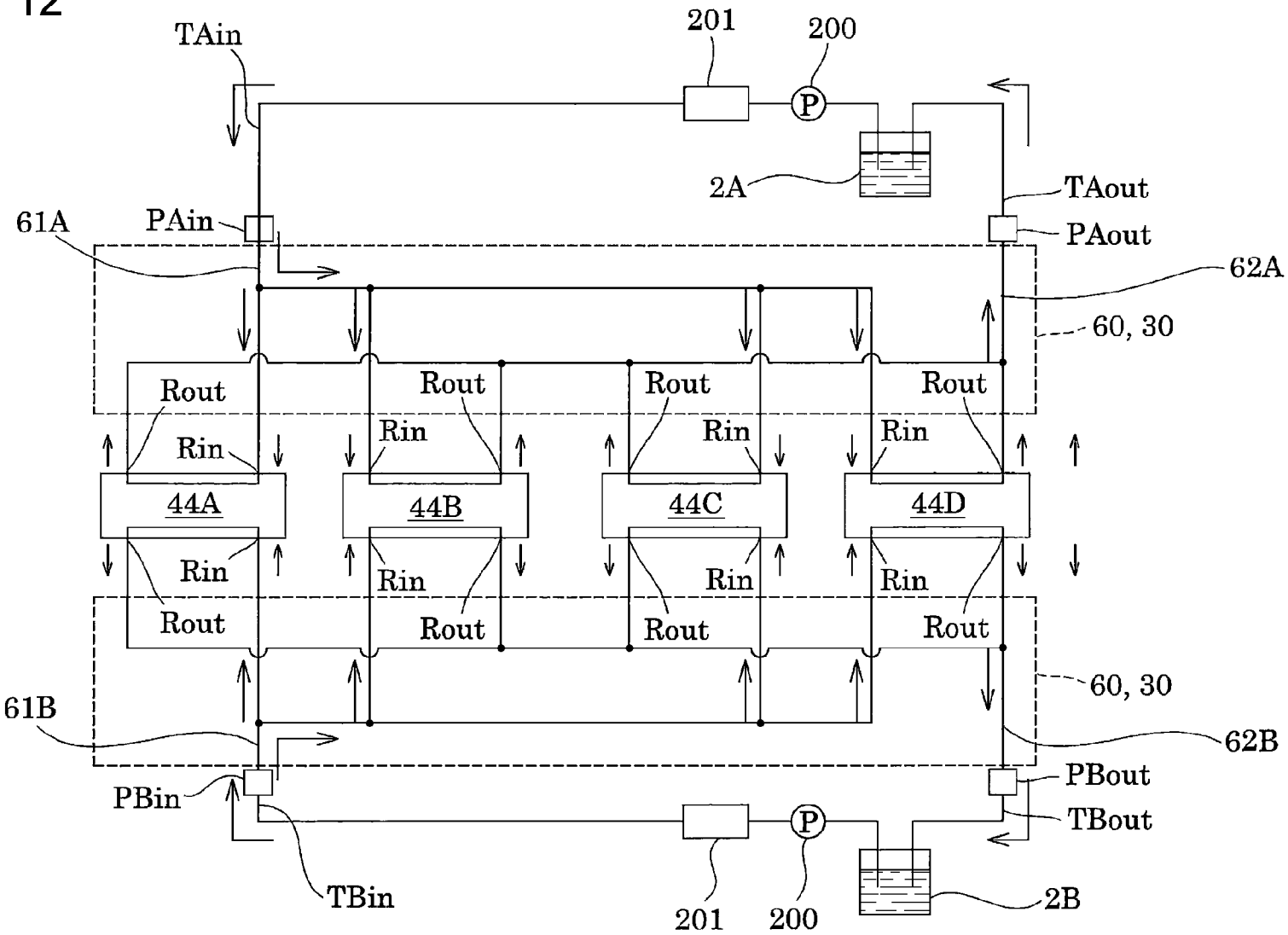
FIG. 12 is a schematic view of a flow path.
Figure 13:
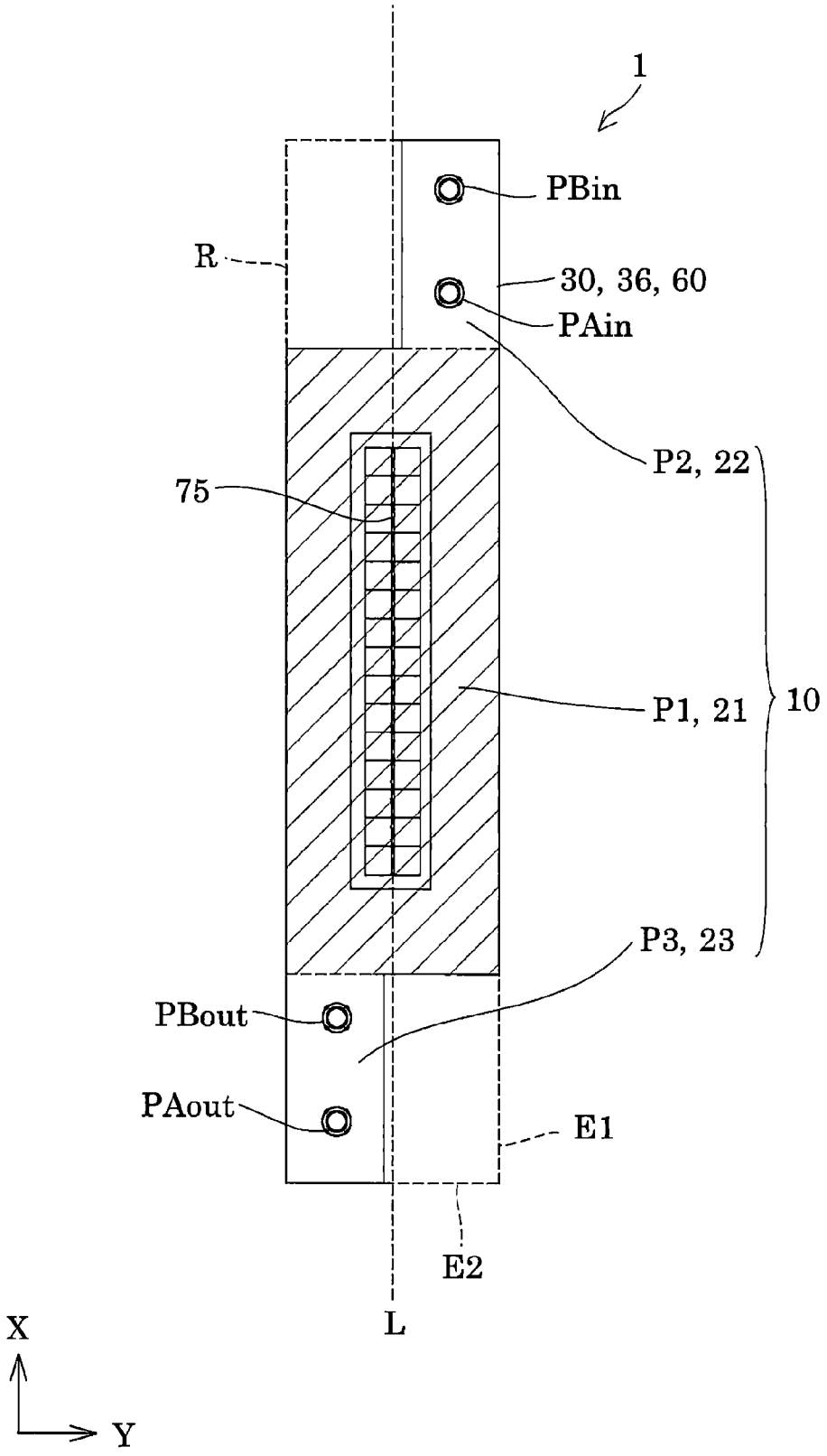
FIG. 13 is a plan view illustrating an ejection surface of the head unit.

Referring to FIGS. 4 to 13, the head unit 1 will be further detailed below. FIG. 4 is a perspective view of the head unit. FIG. 5 is a perspective view showing an inside of the head unit. FIG. 6 is an exploded perspective view of an upper part (−Z-axis side) of the head unit. FIG. 7 is an exploded perspective view of a lower part (+Z-axis side) of the head unit. FIG. 8 is a plan view of the circulation head provided in the head module as viewed from the −Z-axis side. FIG. 9 is a cross-sectional view taken along the line IX-IX of FIG. 8. FIG. 10 is a cross-sectional view of the circulation head, and FIG. 11 is a plan view of the circulation head. FIG. 12 is a schematic view of a flow path. FIG. 13 is a plan view illustrating an ejection surface of the head unit. Furthermore, a cover member 65 is not shown in FIG. 5, and part of the head unit is not shown in in FIG. 8.

As shown in FIGS. 4 to 9, the head unit 1 includes a plurality of circulation heads 44, a holder 30 that holds the circulation heads 44, a flow path member 60 for supplying ink to the circulation heads 44, and a connector 75 to which a wire for transmitting and receiving a control signal or the like to and from the circulation head 44 is connected. In the present embodiment, one head unit 1 includes four circulation heads 44.

As shown in FIGS. 10 and 11, the circulation head 44 of the present embodiment is a structure in which a pressure chamber substrate 482, a vibration plate 483, a piezoelectric actuator 484, a housing 485, and a protective substrate 486 are disposed on a first side of a flow path forming substrate 481, and a nozzle plate 487 and a buffer plate 488 are disposed on a second side of the flow path forming substrate 481.

The flow path forming substrate 481, the pressure chamber substrate 482, and the nozzle plate 487 are made of, for example, a flat silicon plate, and the housing 485 is formed by, for example, injection molding of a resin material. A plurality of nozzles N are formed in the nozzle plate 487. A surface of the nozzle plate 487 on a side opposite to that facing the flow path forming substrate 481 is an ejection surface.

In the flow path forming substrate 481, an opening 481A, a branch flow path 481B, which is a narrowing flow path, and a communication flow path 481C are formed. The branch flow path 481B and the communication flow path 481C are through holes formed for each nozzle N, and the opening 481A is an opening continuous over the plurality of nozzles N. The buffer plate 488 is a compliance substrate formed of a flat plate, which is disposed on a surface of the flow path forming substrate 481 on a side opposite to that facing the pressure chamber substrate 482, and closes the opening 481A. Pressure fluctuation in the opening 481A is absorbed by flexible deformation of the buffer plate 488.

In the housing 485, a manifold SR, which is a common liquid chamber communicating with the opening 481A of the flow path forming substrate 481 is formed. The manifold SR is a space for storing ink supplied to the plurality of nozzles N, and is provided continuously over the plurality of nozzles N. Further, as shown in FIG. 10, the housing 485 has a supply opening Rin through which ink is supplied from an upstream area to the manifold SR, and a discharge opening Rout through which ink is discharged to a downstream area from the manifold SR. The supply opening Rin is connected to a supply tube of the head unit 1 via a supply path, and the discharge opening Rout is connected to a discharge tube of the head unit 1 via a discharge path.

The supply opening Rin is disposed on a first end of the manifold SR (in the present embodiment, +X-axis side) in the X direction, in which the nozzles N are arranged in parallel, and the discharge opening Rout is disposed on a second end of the manifold SR (in the present embodiment, −X-axis side) in the X direction. Then, ink supplied from the supply opening Rin into the manifold SR is discharged outside the manifold SR via the discharge opening Rout. That is, ink circulates in the manifold SR.

Since the ink in the manifold SR circulates and a pressure is applied to the manifold SR, a back pressure is generated in a pressure chamber Sc when ink is ejected from the nozzles N by the pressure in the manifold SR. Further, since the manifold SR is provided with the supply opening Rin and the discharge opening Rout on the first end and the second end in the X direction, respectively, a pressure gradient is generated between the pressure chamber Sc close to the upstream supply opening Rin and the pressure chamber Sc close to the downstream discharge opening Rout. Accordingly, large pressure fluctuation occurs in the pressure chamber Sc close to the upstream supply opening Rin with respect to the pressure chamber Sc close to the downstream discharge opening Rout. Such pressure fluctuation also occurs in the nozzle N that communicates with the above pressure chamber Sc. Accordingly, an ejection amount of ink, that is, the weight of ink also gradually decreases from the upstream supply opening Rin to the downstream discharge opening Rout.

That is, during circulation of ink in the manifold SR, in the plurality of nozzles N communicating with the manifold SR, the pressure of ink in the nozzle N on the first end, which is close to the supply opening Rin, is higher than the pressure of ink in the nozzle N on the second end, which is close to the discharge opening Rout. In the present embodiment, the nozzle N on the first end close to the supply opening Rin is referred to as a first nozzle Na, and the nozzle N on the second end close to the supply opening Rin is referred to as a second nozzle Nb. That is, during circulation, the pressure of ink in the first nozzle Na is higher than the pressure of ink in the second nozzle Nb.

In the pressure chamber substrate 482, an opening 482A is formed for each nozzle N. The vibration plate 483 is an elastically deformable flat plate, which is disposed on the surface of the pressure chamber substrate 482 on a side opposite to that facing the flow path forming substrate 481. A space formed between the vibration plate 483 and the flow path forming substrate 481 inside the opening 482A of the pressure chamber substrate 482 serves as a pressure chamber Sc filled with ink which is supplied from the manifold SR via the branch flow path 481B. The respective pressure chambers Sc communicate with the nozzles N via the communication flow paths 481C of the flow path forming substrate 481.

On the surface of the vibration plate 483 on a side opposite to that facing the pressure chamber substrate 482, a piezoelectric actuator 484 is formed for each nozzle N. Each piezoelectric actuator 484, also called a piezoelectric element, is a drive element in which a piezoelectric body is interposed between electrodes facing each other. The piezoelectric actuator 484 deforms in response to a drive signal to vibrate the vibration plate 483. Accordingly, as the piezoelectric actuator 484 changes the pressure of ink in the pressure chamber Sc, ink in the pressure chamber Sc is ejected from the nozzle N. Further, the protective substrate 486 protects the plurality of piezoelectric actuators 484.

As shown in FIG. 8, a plurality of (in the present embodiment, four) circulation heads 44 are provided in one head unit 1. Specifically, the plurality of circulation heads 44 are held by the holder 30, which is common to the head units 1.

The plurality of circulation heads 44 are arranged at positions different from each other in a XY plane defined by the X direction and the Y direction. That is, the plurality of circulation heads 44 are disposed at positions that do not overlap each other in plan view in the Z direction. The phrase "the plurality of circulation heads 44 are arranged at positions different from each other in the XY plane" means that the ejection surfaces of the circulation heads 44 are positioned at positions different from each other. Accordingly, portions other than the ejection surfaces of the plurality of circulation heads can be disposed at positions overlapping each other in the Z direction.

The circulation heads 44 are arranged with the first nozzle Na being disposed on the first end in the X direction and the second nozzle Nb being disposed on the second end. In the present embodiment, rows composed of the plurality of nozzles arranged in parallel are arrayed in the X direction.

When viewed in plan view in the Z direction, the plurality of circulation heads 44 are arranged such that the second nozzles Nb are positioned on both ends of the head unit 1 in the X direction. That is, when the plurality of circulation heads 44 arranged in parallel in the X direction are referred to as a first circulation head 44A, a second circulation head 44B, a third circulation head 44C, and a fourth circulation head 44D in this order from the −X-axis side to the +X-axis side, the second nozzle Nb is positioned on the −X-axis side of the first circulation head 44A, and the second nozzle Nb is positioned on the +X-axis side of the fourth circulation head 44D. The both ends refer to, among all the nozzles N of the plurality of circulation heads, the nozzles N on the first end in the −X direction and on the second end in the +X direction. The circulation heads 44 are arranged such that the second nozzles Nb are positioned as the nozzles N on both ends.

In other words, the supply opening Rin for supplying ink to the manifold SR (see FIGS. 10 and 11) is positioned on the first end of the manifold SR (in the present embodiment, +X-axis side) in the X direction, in which the nozzles N are arranged in parallel, and the discharge opening Rout is positioned on the second end of the manifold SR (in the present embodiment, −X-axis side) in the X direction. In the present embodiment, when the head unit 1 is viewed in plan view in the Z direction, the plurality of circulation heads 44 are arranged such that the discharge openings Rout are positioned on both ends in the X direction.

Therefore, when the head units 1 are arrayed in the X direction to form the head module 100, the pressure difference between the adjacent nozzles N between two head units 1 adjacent to each other in the X direction can be reduced to thereby reduce the weight difference of ink ejected from the adjacent nozzles N. Accordingly, the density of ink ejected from the nozzles N can be prevented from being significantly different between two adjacent liquid ejecting head units, and the difference in density can be prevented from visually recognized as color unevenness.

Further, in the present embodiment, two circulation heads 44 adjacent to each other in the X direction, that is, two circulation heads 44 partially overlapping each other in the Y direction are arranged such that the nozzle N of one circulation head 44 on the end close to the other circulation head 44 is the same type as the nozzle N of the other circulation head on the end close to the one circulation head are the same type. That is, of two circulation heads adjacent to each other in the X direction, when the nozzle N of one circulation head on the end close to the other circulation head is the first nozzle Na, the nozzle N of the other circulation head on the end close to the one circulation head is also the first nozzle Na. Similarly, of two circulation heads adjacent to each other in the X direction, when the nozzle N of one circulation head on the end close to the other circulation head is the second nozzle Nb, the nozzle N of the other circulation head on the end close to the one circulation head is also the second nozzle Nb.

In the present embodiment, in the first circulation head 44A and the second circulation head 44B adjacent to each other in the X direction, the nozzle N of the first circulation head 44A on the +X-axis end is the first nozzle Na, and the nozzle N of the second circulation head 44B on the −X-axis end is also the first nozzle Na.

Similarly, in the second circulation head 44B and the third circulation head 44C adjacent to each other in the X direction, the nozzle N of the second circulation head 44B on the +X-axis end is the second nozzle Nb, and the nozzle N of the third circulation head 44C on the −X-axis end is also the second nozzle Nb.

Similarly, in the third circulation head 44C and the fourth circulation head 44D adjacent to each other in the X direction, the nozzle N of the third circulation head 44C on the +X-axis end is the first nozzle Na, and the nozzle N of the fourth circulation head 44D on the −X-axis end is also the first nozzle Na.

Thus, in the circulation heads 44 adjacent to each other in the X direction, since the nozzles N on the ends overlapping each other in the Y direction are of the same type, the pressure difference during circulation between the adjacent nozzles N between two circulation heads 44 adjacent to each other in the X direction can be reduced.

Accordingly, in the circulation heads 44 adjacent to each other in the X direction, the weight difference of ink ejected from the adjacent nozzles N can be reduced. Accordingly, the density of ink ejected from the nozzles N can be prevented from being significantly different between two adjacent circulation heads 44, and the difference in density can be prevented from visually recognized as color unevenness.

Furthermore, in order to allow the same type of nozzles to be positioned as the nozzles N on the ends overlapping each other in the Y direction in the circulation heads 44 adjacent to each other in the X direction, the number of the circulation heads 44 is required to be an even number. That is, when the number of the circulation heads 44 is an odd number, and the second nozzles Nb are positioned on both ends of the liquid ejecting head unit in the X direction in plan view of the plurality of circulation heads in the Z direction, an arrangement that reduces the weight difference of ink between all two circulation heads 44 adjacent to each other in the X direction cannot be achieved. Accordingly, in order to position the second nozzles Nb on both ends of the head unit 1 in the X direction in plan view of the plurality of circulation heads 44 in the Z direction, and, in order to allow the same type of nozzles to be positioned as the nozzles N on the ends overlapping each other in the Y direction in the circulation heads 44 adjacent to each other in the X direction, the number of the circulation heads 44 is an even number.

Furthermore, it is also possible to use a heat generating element, instead of the piezoelectric actuator 484, disposed in the flow path, so that ink droplets are ejected from the nozzles N by means of bubbles generated by heat from the heat generating element, or to use an electrostatic actuator for generating electrostatic force between the vibration plate 483 and the electrode so that ink droplets are ejected from the nozzles N by means of electrostatic force that causes the vibration plate 483 to be deformed.

As shown in FIGS. 8, 10, and 11, in the circulation head 44, the nozzles N are arranged in parallel in the X direction. Furthermore, in the circulation head 44, a plurality of rows (in the present embodiment, two rows) in which the nozzles N are arranged in parallel in the X direction are arranged in the Y direction. That is, in one circulation head 44, two circulation flow paths communicating with the supply opening Rin, the manifold SR extending along a row of the nozzles N, and the discharge opening Rout are formed. One of the two circulation flow paths may be referred to as a circulation flow path A, and the other may be referred to as a circulation flow path B.

As shown in FIGS. 7, 9, and other drawings, four circulation heads 44 are held by the holder 30.

The holder 30 has a recess 33 that is open to the surface on the +Z-axis side. On the bottom of the recess 33, a recess-shaped accommodating portion 31 is provided. The recess 33 has an opening of a size and shape that allow the fixation plate 36 to be fitted and fixed therein. Furthermore, the accommodating portion 31 has an opening of a size and shape that allow the circulation head 44 to be accommodated therein.

The holder 30 has the flange 35 on the surface on the −Z-axis side. The fixation ports 104 described above are provided on both ends of the flange 35 in the X direction.

The circulation heads 44 are fixed to the fixation plate 36. Specifically, the fixation plate 36 is formed in a shape to be accommodated in the recess 33, and has exposure openings 37 formed at predetermined positions. The circulation heads 44 are fixed to the fixation plate 36 with an adhesive or the like such that the buffer plate 488 (see FIG. 10) is covered by the fixation plate 36 and the nozzles N (nozzle plate 487) are exposed through the exposure openings 37. The circulation head 44 thus fixed to the fixation plate 36 is housed in the accommodating portion 31 with the nozzle plate 487 facing the +Z-axis side. The fixation plate 36 is fixed to the recess 33 with an adhesive or the like. Furthermore, the surface on the −Z-axis side of the circulation head 44 is adhered to the bottom of the accommodating portion 31 with an adhesive.

That is, the circulation head 44 is housed in a space formed by the accommodating portion 31 and the fixation plate 36, and the nozzle N is exposed through the exposure opening 37. Alternatively, the accommodating portion 31 may also be provided common to the plurality of circulation heads 44.

In the holder 30, the circulation heads 44 are arranged in a zig-zag pattern in the X direction. The phrase "the circulation heads 44 are arranged in a zig-zag pattern in the X direction" means that the circulation heads 44 that are arranged in parallel in the X direction are positioned alternately offset in the Y direction. That is, two rows composed of the circulation heads 44 arranged in parallel in the X direction are arranged in parallel in Y direction, and the two rows of the circulation heads 44 are offset from each other by a half pitch in the X direction. Since the circulation heads 44 are arranged in a zig-zag pattern in the X direction as described above, the rows of the nozzles N continuous in the X direction are formed with the nozzles N of two circulation heads 44 partially overlapping with each other in the X direction.

As shown in FIGS. 5, 6, 9 and 12, the flow path member 60 is a member in which a flow path for supplying ink to the circulation head 44 is formed. Although not shown in the figure, the flow path member 60 is formed by laminating a plurality of resin members, and a flow path is formed by combining a planar flow path provided between the members and a through hole penetrating the members.

In the present embodiment, a supply flow path 61A and a supply flow path 61B for supplying ink to the circulation head 44, and a discharge flow path 62A and a discharge flow path 62B for discharging ink from the circulation head 44 are formed.

Furthermore, on the surface on the −Z-axis side of the flow path member 60, a supply port PAin, a supply port PBin, a discharge port PAout, and a discharge port PBout each having a cylindrical shape protruding in the −Z direction are provided. The supply port PAin and the supply port PBin may also be collectively referred to as a supply port. The discharge port PAout and the discharge port PBout may also be collectively referred to as a discharge port. Further, the supply port and the discharge port may also be collectively referred to as a port. The supply port PAin communicates with the supply flow path 61A, and the supply port PBin communicates with the supply flow path 61B. Further, the discharge port PAout communicates with the discharge flow path 62A, and the discharge port PBout communicates with the discharge flow path 62B.

A tube is detachably connected to the respective ports. The supply tube TAin is connected to the supply port PAin, and the supply tube TBin is connected to the supply port PBin. Further, the discharge tube TAout is connected to the discharge port PAout, and the discharge tube TBout is connected to the discharge port PBout.

The supply flow path 61A branches into four flow paths in the flow path member 60. The branch flow paths each communicate with the communication paths 34 (see FIG. 6) formed in the holder 30. Similarly, the supply flow path 61B branches into four flow paths in the flow path member 60. The branch flow paths each communicate with the communication paths 34 (see FIG. 6) formed in the holder 30.

The discharge flow path 62A branches into four flow paths in the flow path member 60. The branch flow paths each communicate with the communication paths 34 (see FIG. 6) formed in the holder 30. Similarly, the discharge flow path 62B branches into four flow paths in the flow path member 60. The branch flow paths each communicate with the communication paths 34 (see FIG. 6) formed in the holder 30.

Four communication paths 34 are provided in each circulation head 44. Each communication path 34 communicates with two supply openings Rin and two discharge openings Rout.

Ink in the liquid container 2A is pressurized to a predetermined pressure by the pump 200 and heated to a predetermined temperature by the heater 201, and is then supplied to the supply flow path 61A via the supply tube TAin and the supply port PAin. Then, ink branches from the supply flow path 61A, and is supplied to the respective circulation flow paths A (supply openings Rin) of the four circulation heads 44 via the communication paths 34. Ink discharged from the respective circulation flow paths A (discharge openings Rout) of the four circulation heads 44 joins the discharge flow path 62A via the communication paths 34, and returns to the liquid container 2A via the discharge port PAout and the discharge tube TAout.

Ink in the liquid container 2B is pressurized to a predetermined pressure by the pump 200 and heated to a predetermined temperature by the heater 201, and is then supplied to the supply flow path 61B via the supply tube TBin and the supply port PBin. Then, ink branches from the supply flow path 61B, and is supplied to the respective circulation flow paths B (supply openings Rin) of the four circulation heads 44 via the communication paths 34. Ink discharged from the respective circulation flow paths B (discharge openings Rout) of the four circulation heads 44 joins the discharge flow path 62B via the communication paths 34, and returns to the liquid container 2B via the discharge port PBout and the discharge tube TBout.

The holder 30, having the communication paths 34 through which ink flows as described above, also serves as a flow path member. That is, in the present embodiment, the holder 30 and the flow path member 60 correspond to a flow path member recited in the claims.

As shown in FIGS. 5 and 9, the flow path member 60 having the above configuration is fixed to the −Z-axis side of the holder 30. Further, the flow path member 60 is housed in the cover member 65. Specifically, the cover member 65 is a box-shaped member having an accommodating portion 66 that is open to the +Z-axis side. The cover member 65 is fixed to the holder 30 with the flow path member 60 being housed in the accommodating portion 66.

Furthermore, the cover member 65 has four through holes 67 (see FIG. 6) provided on the −Z-axis side. The supply port PAin, the supply port PBin, the discharge port PAout, and the discharge port PBout are exposed outside through the four through holes 67.

As shown in FIGS. 5, 6 and 9, in addition to the flow path member 60, various electrical components such as the connector 75 are housed in the accommodating portion 66 of the cover member 65.

Specifically, a first circuit board 71 is provided on a side surface on the +Y-axis side of the flow path member 60, and a second circuit board 72 is provided on a side surface on the −Y-axis side. Further, a third circuit board 73 is provided on the top on the −Z-axis side of the flow path member 60. The first circuit board 71, the second circuit board 72 and the third circuit board 73 may also be collectively referred to as a circuit board 70.

The connector 75 is provided on the third circuit board 73. The connector 75 is exposed through a connection opening 63, which is a through hole on the top of the cover member 65 on the −Z-axis side. A wiring (not shown) for connecting to an external control unit 3 is connected to the connector 75.

Moreover, the third circuit board 73 has a terminal section (not shown) to which a first connection wiring 91 and a second connection wiring 92 are connected. The first connection wiring 91 is connected to a terminal section (not shown) of the first circuit board 71, and the second connection wiring 92 is connected to a terminal section (not shown) of the second circuit board 72.

The first circuit board 71 is connected to the third circuit board 73 via the first connection wiring 91. Further, two relay wirings 90 are connected to the first circuit board 71. Each relay wiring 90 is connected to the circulation head 44 (the second circulation head 44B or the fourth circulation head 44D) via a relay substrate 95 and a wiring substrate 96.

The second circuit board 72 is connected to the third circuit board 73 via the second connection wiring 92. Further, two relay wirings 90 are connected to the second circuit board 72. Each relay wiring 90 is connected to the circulation head 44 (the first circulation head 44A or the third circulation head 44C) via the relay substrate 95 and the wiring substrate 96.

The relay substrate 95 is provided on the −Z-axis side of the holder 30. Furthermore, the holder 30 has a communication hole 39 that penetrates in the Z direction to communicates the accommodating portion 31 and the −Z-axis side of the holder 30. The wiring substrate 96 connected to the circulation head 44 is inserted into the communication hole 39. One end of the wiring substrate 96 is connected to the circulation head 44, and the other end is connected to the relay substrate 95. The relay wiring 90 and the wiring substrate 96 may be made of a flexible sheet-shaped material such as a COF substrate. In addition, the relay wiring 90 and the wiring substrate 96 may be made of FFC, FPC, or the like.

The wiring substrate 96 is a substrate on which a wiring for supplying a signal and a power supply for driving the circulation head 44 is mounted. The wiring substrate 96 is connected to the first circuit board 71 or the second circuit board 72 via the relay substrate 95 and the relay wiring 90.

With this configuration of the circuit board 70, a print signal and a power supply from the control unit 3 is supplied from the connector 75 to the third circuit board 73. The print signal or the like is supplied to the second circulation head 44B and the fourth circulation head 44D via the first connection wiring 91, the first circuit board 71, the relay substrate 95 and the wiring substrate 96. Further, the print signal or the like is supplied to the first circulation head 44A and the third circulation head 44C via the second connection wiring 92, the second circuit board 72, the relay substrate 95 and the wiring substrate 96. In addition, a signal detected by various sensors provided on the circulation head 44, the wiring substrate 96, and the like may be transmitted to the control unit 3.

The head unit 1 having the above configuration ejects ink droplets from the nozzles N, when ink is supplied from the liquid container 2 to the circulation head 44 via the flow path member 60, and a print signal or the like is transmitted from the control unit 3 to the circulation head 44 via the circuit board 70 or the like so that the piezoelectric actuator 484 in the circulation head 44 is driven in response to the print signal or the like.

Referring to FIG. 13, an ejection surface 10 of the head unit will be described. FIG. 13 illustrates the connector 75, the supply port PAin, the supply port PBin, the discharge port PAout, and the discharge port PBout, and a schematic shape of the flow path member 60, the holder 30, and the fixation plate 36.

The ejection surface is a surface of the head unit 1 facing the medium S. In the present embodiment, a surface on the +Z-axis side of the fixation plate 36 is an ejection surface 10.

A minimum area including the ejection surface 10 is defined as a rectangle R. In the present embodiment, a long side E1 of the rectangle R overlaps a side of the holder 30 extending in the X direction, and a short side E2 of the rectangle R overlaps a side of the holder 30 extending in the Y direction. A center line parallel to the long side E1 of the virtual rectangle R is denoted as L.

The planar shape of the ejection surface 10 includes a first portion P1 (hatched portion in FIG. 13) through which the center line L passes, and a second portion P2 and a third portion P3 through which the center line L does not pass. The third portion P3 and the second portion P2 are positioned with the first portion P1 interposed therebetween. In the present embodiment, the first portion P1, the second portion P2, and the third portion P3 all have a rectangular shape.

The flow path member 60 constituting the head unit 1 has a planer shape similar to that of the ejection surface 10. The planar shape of the flow path member 60 may not necessarily have exactly the same shape as the ejection surface 10, but has a shape having portions corresponding to the first portion P1, the second portion P2, and the third portion P3 described above. The same applies to the planar shape of the holder 30 and the cover member 65.

In plan view of the ejection surface 10, a portion of the flow path member 60 overlapping the first portion P1 is referred to as a first flow path portion 21, a portion overlapping the second portion P2 is referred to as a second flow path portion 22, and a portion overlapping the third portion P3 is referred to as a third flow path portion 23.

The connector 75 is disposed in the first flow path portion 21. Further, the supply port PAin and the supply port PBin are disposed in the second flow path portion 22. Further, the discharge port PAout and the discharge port PBout are disposed in the third flow path portion 23.

The supply port PAin and the supply port PBin are positioned displaced from each other in the X direction on the surface on the −Z-axis side of the second flow path portion 22. The phrase "positioned displaced from each other in the X direction" as used herein means that the positions of the supply port PAin and the supply port PBin are displaced in the X direction. In the example shown in FIG. 13, the supply port PAin and the supply port PBin are positioned displaced on a straight line extending in the X direction. The same applies to the discharge port PAout and the discharge port PBout.

Further, as shown in FIG. 13, the supply port PBin, the supply port PAin, the discharge port PBout, and the discharge port PAout are disposed in this order from the +X axis to the −X axis.

Specifically, in the second flow path portion 22, the supply port PBin and the supply port PAin are disposed in this order from the +X axis to the −X axis. In the third flow path portion 23, the discharge port PBout and the discharge port PAout are disposed in this order from the +X axis to the −X axis.

With this arrangement of the supply port and the discharge port, the flow path extending from the supply port PAin to the discharge port PAout and the flow path extending from the supply port PBin to the discharge port PBout can be easily set to be of the equal length so that these flow paths have the equal flow path resistance. Accordingly, variation in the amount of ink ejected from the circulation flow path A and the circulation flow path B of the circulation head 44 can be reduced.

In the case where the circulation head 44 includes three flow paths of the circulation flow path A, the circulation flow path B, and a circulation flow path C, the flow path member 60 may have a supply port PCin, the supply port PBin, the supply port PAin, a discharge port PCout, the discharge port PBout, and the discharge port PAout disposed in this order from the +X axis to the −X axis. The supply port PCin and the discharge port PCout are examples of the connecting portion communicating with the circulation flow path C. In the case where four or more circulation flow paths are provided, the supply port and the discharge port may be disposed in a similar manner.

Further, the order of the supply ports in the second flow path portion 22, and the order of the discharge ports in the third flow path portion 23 may be opposite to those shown in FIG. 13. That is, the supply port PAin, the supply port PBin, the discharge port PAout, and the discharge port PBout can be disposed in this order from the +X axis to the −X axis.

In other words, in the second flow path portion 22, the connecting portions, each of which communicates with different circulation flow path (in the example of FIG. 13, the supply port PBin and the supply port PAin, which communicate with the circulation flow path A and the circulation flow path B, respectively) are arranged in parallel from the +X axis to the −X axis. On the other hand, in the third flow path portion 23, the connecting portions (the discharge port PBout and the discharge port PBout), which are paired with the connecting portions arranged in the second flow path portion 22 (in the example of FIG. 13, the supply port PBin and the supply port PAin), are arranged in the same order as these connecting portions from the +X axis to the −X axis. With this arrangement of the supply port and the discharge port, the flow paths extending from the supply ports to the discharge ports can be easily set to be of the equal length as described above so that these flow paths have the equal flow path resistance. Accordingly, variation in the amount of ink ejected from the plurality of circulation flow paths of the circulation head 44 can be reduced.

Furthermore, although the supply port PBin, the supply port PAin, the discharge port PBout, and the discharge port PAout are arranged in the second flow path portion 22 and the third flow path portion 23 from the +X axis to the −X axis as described above, the configuration is not limited thereto. That is, the plurality of supply ports and the discharge ports can be arranged in any order as long as the plurality of supply ports and the discharge ports are disposed displaced in the X direction as described above.

In the flow path member 60 of the head unit 1 having the structure described above, the port is not provided in the first flow path portion 21 in which the connector 75 is disposed, and the port is provided in the second flow path portion 22 and the third flow path portion 23. With this configuration, a distance between the supply port PAin and the supply port PBin, and the discharge port PAout and the discharge port PBout can be ensured. Therefore, the tubes can be attached to these ports with ease.

The connector 75, which is an electrical component, is provided in the first flow path portion 21. Further, the port, through which ink is distributed, is provided in the second flow path portion 22 and the third flow path portion 23. With this configuration, spill of ink onto the connector 75 can be prevented during attachment and detachment of the tubes to and from the ports. Accordingly, the occurrence of a defect such as short circuit of the head unit 1 due to ink can be prevented, leading to an improved reliability.

The second flow path portion 22 and the third flow path portion 23 in which the port is provided are located on the outside of the first flow path portion 21 in the X direction. Accordingly, compared to a configuration in which a portion in which the port is provided (portion corresponding to the second flow path portion 22 and the third flow path portion 23) is located on the outside of the first flow path portion 21 in the Y direction, a width in the Y direction can be reduced and thus the head unit 1 can be reduced in size.

Furthermore, the supply port PAin and the supply port PBin are positioned displaced from each other in the X direction, and the discharge port PAout and the discharge port PBout are positioned displaced from each other in the X direction. With this arrangement of the ports, a width of the head unit 1 in the Y direction can be reduced and thus the head unit 1 can be reduced in size.

In particular, in the present embodiment, the supply port PAin and the supply port PBin are positioned on a straight line extending in the X direction, and the discharge port PAout and the discharge port PBout are positioned on a straight line extending in the X direction. With this arrangement of the ports, a width of the head unit 1 in the Y direction can be reduced and thus the head unit 1 can be further reduced in size. The ports may not be necessarily displaced from each other on a straight line extending in the X direction as long as the ports are displaced in the X direction.

In addition, in the case where the port is provided in the first flow path portion 21, a distance between the ports is reduced since all the ports are concentrated and components such as the connector 75 are also provided. Therefore, the tubes cannot be attached to the ports with ease. Further, since the port is positioned close to the connector 75, there is a risk that ink may be spilled out from the port or the tube onto the connector 75.

Further, in the case where the supply port PAin and the supply port PBin are positioned without being displaced in the X direction, that is, where they are positioned displaced in the Y direction, a width of the head unit 1 in the Y direction is increased, leading to an increase in size of the head unit 1.

In addition, a decrease in the width of the head unit 1 in the Y direction may also be regarded as an increase in the width in the X direction. However, since the X direction is a direction in which the nozzles N are arranged in parallel, the head unit 1 needs to have a predetermined width in the X direction. Referring to the example of FIG. 8, the nozzles N are arranged in parallel in a range of the row of the nozzles N in the X direction, that is, a range of the row extending from the second nozzle Nb of the first circulation head 44A on the −X-axis end to the second nozzle Nb of the fourth circulation head 44D on the +X-axis end. Thus, an increase in size in the X direction is not problematic in practical use as long as the ports are disposed within the range.

On the other hand, as shown in FIG. 3, an increase in the width of the head unit 1 in the Y direction causes an increase in a space between the rows of the nozzles N of the head units 1 adjacent to each other in the Y direction. This is not preferred since an increase in such a space makes it difficult to adjust the timing of ejecting ink from the head unit 1.

Furthermore, in the head unit 1 of the present embodiment, in which the second flow path portion 22 and the third flow path portion 23 are located on both sides of the first flow path portion 21, the supply port PAin and the supply port PBin are disposed in the second flow path portion 22, while the discharge port PAout and the discharge port PBout are disposed in the third flow path portion 23. Since the ports are distributed in the second flow path portion 22 and the third flow path portion 23, a distance between the ports can be ensured, and thus work efficiency in attaching the tubes is improved.

Furthermore, in the head unit 1 of the present embodiment, the second flow path portion 22 and the third flow path portion 23 are positioned with the center line L (see FIG. 13) interposed therebetween. With this configuration, as shown in FIG. 3, in two head units 1 arrayed in the X direction, the second flow path portion 22 of one of the head units 1 and the third flow path portion 23 of the other can be aligned in the Y direction. Accordingly, a space between the head units 1 aligned in the X direction can be narrowed to thereby contribute to downsizing of the head module 100.

Furthermore, in the head unit 1 of the present embodiment, the supply port PAin and the supply port PBin are disposed in the second flow path portion 22, and the discharge port PAout and the discharge port PBout are disposed in the third flow path portion 23. Thus, the supply ports are disposed in the second flow path portion 22, and the discharge ports are disposed in the third flow path portion 23. With this configuration, errors in connection of tubes can be easily prevented from occurring.

Furthermore, since the supply port and the discharge port are not mixed in each of the second flow path portion 22 and the third flow path portion 23, arrangement of the tubes can be prevented from being complicated.

Figure 14:
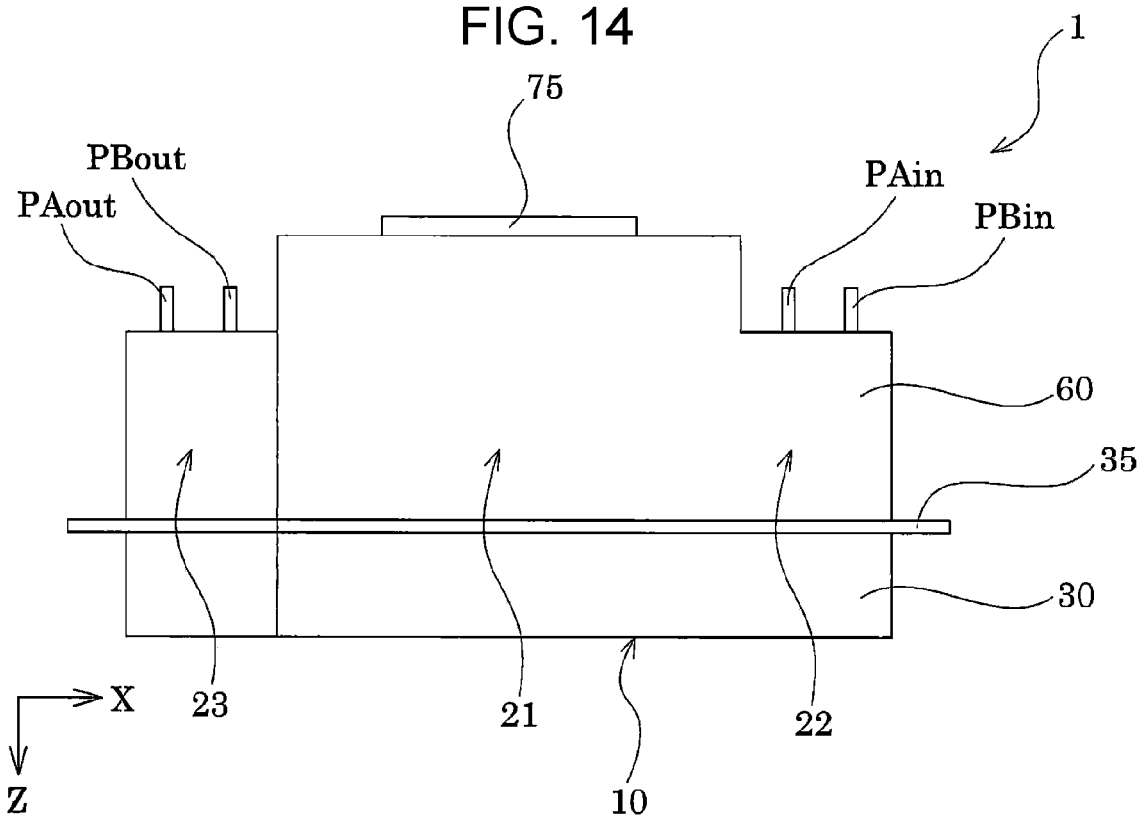
FIG. 14 is a side view of the head unit.

Referring to FIG. 14, a height of the port will be described. FIG. 14 is a side view of the head unit 1 according to the present embodiment. In the drawing, the cover member 65 is not illustrated.

The respective ports are located closer to the ejection surface 10 in the Z direction perpendicular to the ejection surface 10 than the connector 75 is located. The phrase "the respective ports are located closer to the ejection surface 10 in the Z direction than the connector 75 is located" means that the respective ports are located closer to the ejection surface 10 at least than the terminal section of the connector 75 is located. In the present embodiment, in the case where the connector 75 is exposed through the connection opening 63 (see FIG. 6) of the cover member 65, the phrase means that the ports are located closer to the ejection surface 10 than a portion of the connector 75 which is exposed from the cover member 65 is located.

Since the ports are located closer to the ejection surface 10 in the Z direction than the connector 75 is located, the connector 75 can be prevented from being exposed to ink even if ink leakage from the ports occurs, and thus a failure such as short circuit of the electrical components due to ink leakage can be reduced.

Figure 15:
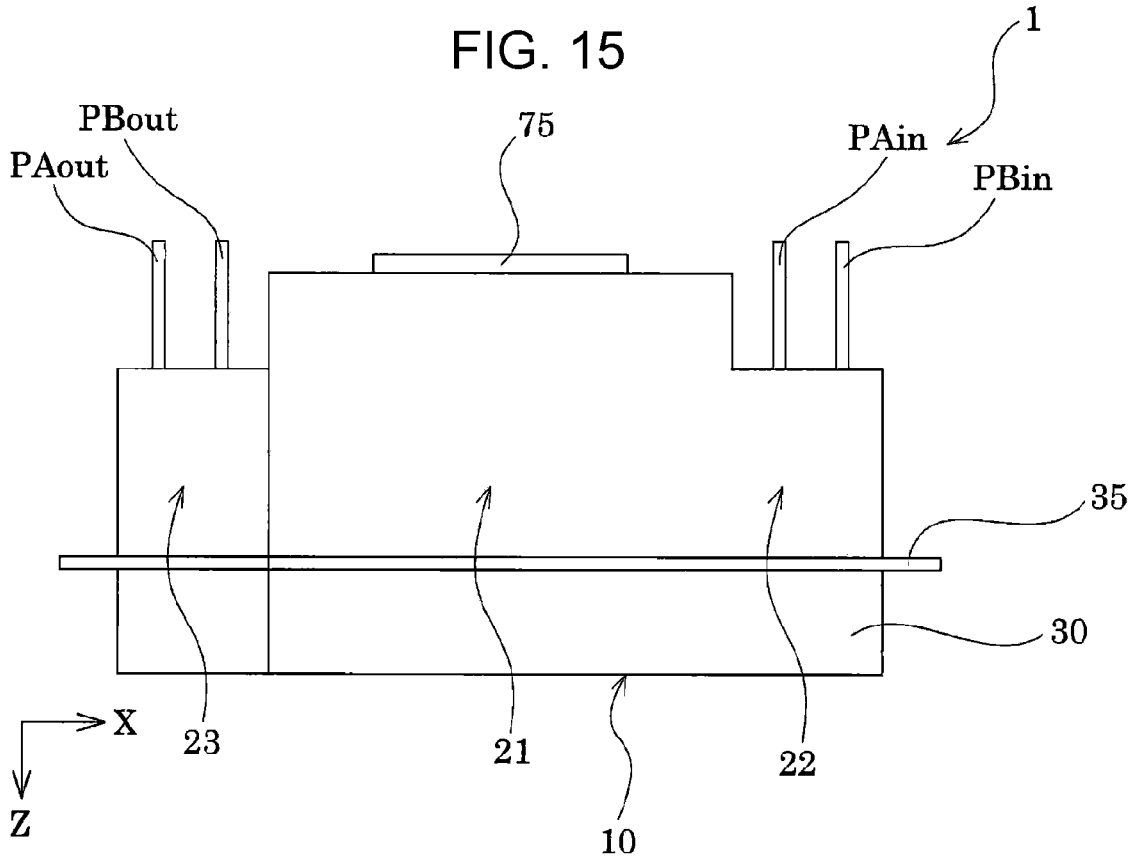
FIG. 15 is a side view of the head unit.

Referring to FIG. 15, a modified example of a height of the port will be described. FIG. 15 is a side view of the head unit 1 according to a modified example of the present embodiment. In the drawing, the cover member 65 is not illustrated, and the same components as those in FIG. 14 are denoted by the same reference numbers.

The respective ports are located farther from the ejection surface 10 in the Z direction perpendicular to the ejection surface 10 (on the −Z-axis side) than the connector 75 is located. The phrase "the respective ports are located farther from the ejection surface 10 in the Z direction than the connector 75 is located" means that at least parts of the respective ports (top ends on the −Z-axis side) are located farther from the ejection surface 10 than the terminal section of the connector 75 is located. In the present embodiment, in the case where the connector 75 is exposed through the connection opening 63 (see FIG. 6) of the cover member 65, the phrase means that parts of the respective ports are located farther from the ejection surface 10 than a portion of the connector 75 which is exposed from the cover member 65 is located.

Since the respective ports protrude farther than the connector 75 does in the −Z direction, interference by the connector 75 is less likely to occur, and thus attachment and detachment of the tubes to and from the ports are facilitated.

Figure 16:
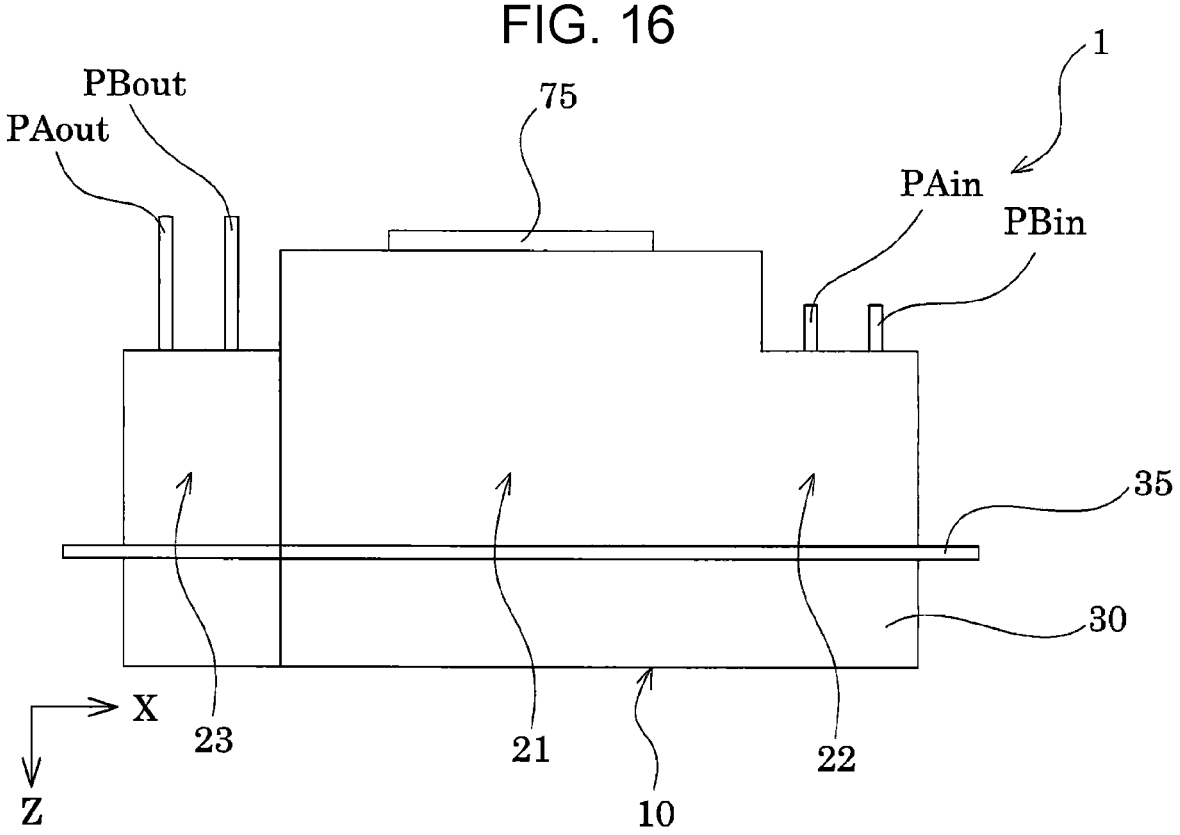
FIG. 16 is a side view of the head unit.

Referring to FIG. 16, a modified example of a height of the port will be described. FIG. 16 is a side view of the head unit 1 according to a modified example of the present embodiment. In the drawing, the cover member 65 is not illustrated, and the same components as those in FIG. 14 are denoted by the same reference numbers.

In the respective ports, a height of the supply port disposed in the second flow path portion 22 is different from a height of the discharge port disposed in the third flow path portion 23 in the Z direction, which is perpendicular to the ejection surface 10. In the present embodiment, the discharge port has a height larger than the supply port in the Z direction.

Since the supply port and the discharge port have different heights, errors in connection of the supply tubes and the discharge tubes to the ports can be easily prevented from occurring.

Although the discharge port is higher than the supply port in the example shown in the figure, the disclosure is not limited thereto, and vice versa is also available. Further, although the supply port is lower than the connector 75 in the Z direction and the discharge port is higher than the connector 75 in the Z direction, the disclosure is not limited thereto. That is, the supply port and the discharge port may have any height regardless of the height of the connector 75 as long as they are different from each other.

Figure 17:
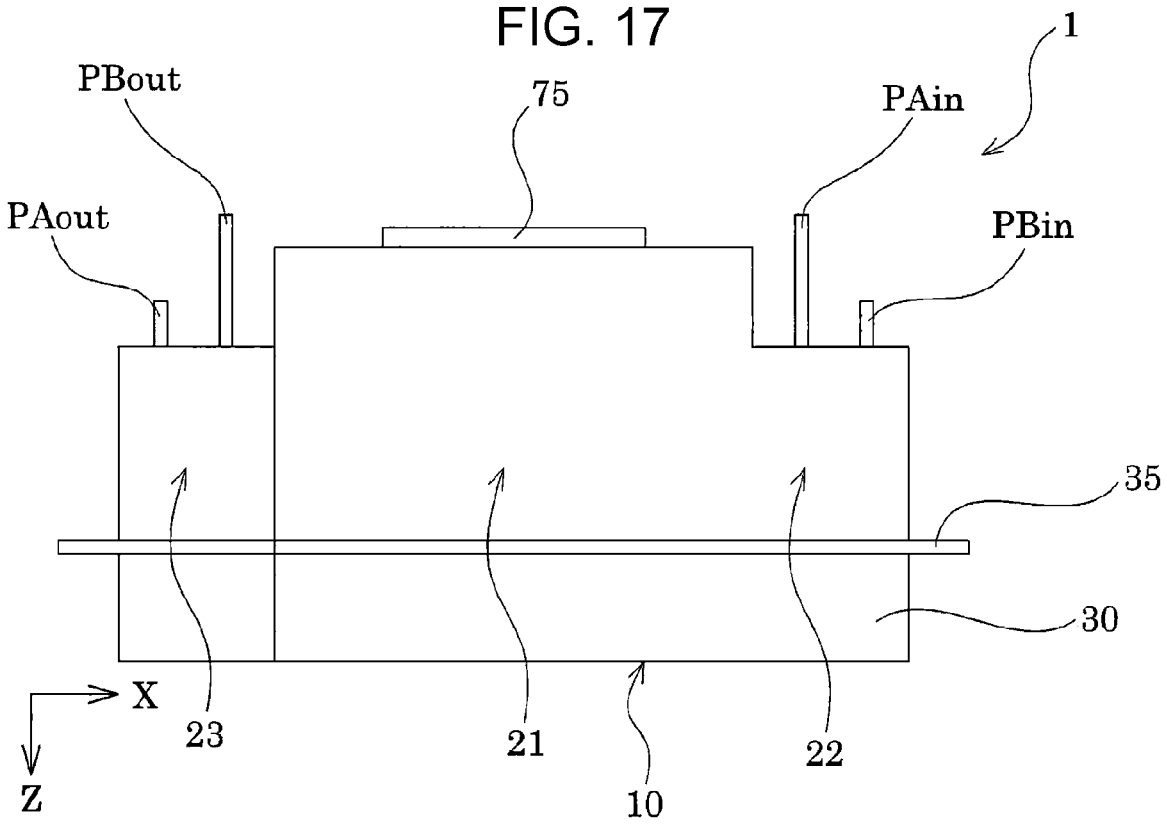
FIG. 17 is a side view of the head unit.

Referring to FIG. 17, a modified example of a height of the port will be described. FIG. 17 is a side view of the head unit 1 according to a modified example. In the drawing, the cover member 65 is not illustrated, and the same components as those in FIG. 14 are denoted by the same reference numbers.

The port located closer to the first flow path portion 21 of the flow path flow path member 60, which corresponds to the first portion P1 (see FIG. 13) of the ejection surface 10 in the X direction, has a greater height in the Z direction. Specifically, in the second flow path portion 22, the supply port PBin, which is located closer to the first flow path portion 21 than the supply port PAin is, has a greater height.

Similarly, in the third flow path portion 23, the discharge port PBout, which is located closer to the first flow path portion 21 than the discharge port PAout is, has a greater height.

Since the ports have different heights, errors in connection of the supply tubes and the discharge tubes to the ports can be easily prevented from occurring. Further, the port located farther from the first flow path portion 21 in the X direction has a smaller height in the Z direction. Therefore, attachment and detachment of the tubes to and from the ports are facilitated.

In addition, as shown in the figure, the port located close to the first flow path portion 21 has a height higher than the connector 75. However, the disclosure is not limited thereto. That is, the port located closer to the first flow path portion 21 may have greater height regardless of the height of the connector 75.

Moreover, as shown in FIGS. 14 to 17, the top portions (top portions in the −Z-axis side) of the second flow path portion 22 and the third flow path portion 23 in which the ports are disposed are located closer to the ejection surface 10 in the Z direction than the top portion (top portion in the −Z-axis side) of the first flow path portion 21 in which the connector 75 is disposed is located.

Since the ports are located closer to the ejection surface 10 in the Z direction than the connector 75 is located, ink is not likely to flow toward the connector 75 even if ink leakage from the ports occurs. Accordingly, a failure such as short circuit of the electrical components due to ink leakage can be reduced.

Further, as shown in FIGS. 14 to 17, the flange 35 is supported by the support body 101 (see FIG. 2). The flange 35 has the fixation ports 104 (see FIG. 2) for fixing the head unit 1 to the support body 101. The head unit 1 is fixed to the support body 101 with the screws 103. The fixation port 104 corresponds to a head fixation portion recited in the claims.

The fixation ports 104 are located closer to the ejection surface 10 in the Z direction than the respective ports are located. With this configuration, the fixation ports 104 for fixing the head unit 1 to the support body 101 and the screws 103 inserted into the fixation ports 104 are located away from the vicinity of the ports. Accordingly, while the head unit 1 is mounted on the support body 101, attachment of the tubes to the ports is facilitated.

Further, as shown in FIGS. 2 and 3, the fixation ports 104 are disposed on the outside of the head unit 1 in the X direction. Specifically, the fixation ports 104 are disposed on both ends of the head unit 35 of the head unit 1 in the X direction. With this arrangement of the fixation ports 104, a width of the head unit 1 in the Y direction can be reduced and thus the head unit 1 can be reduced in size. Although not shown in the figure, the fixation port 104 may also be disposed on the outside of the head unit 1 in the Y direction.

Figure 18:
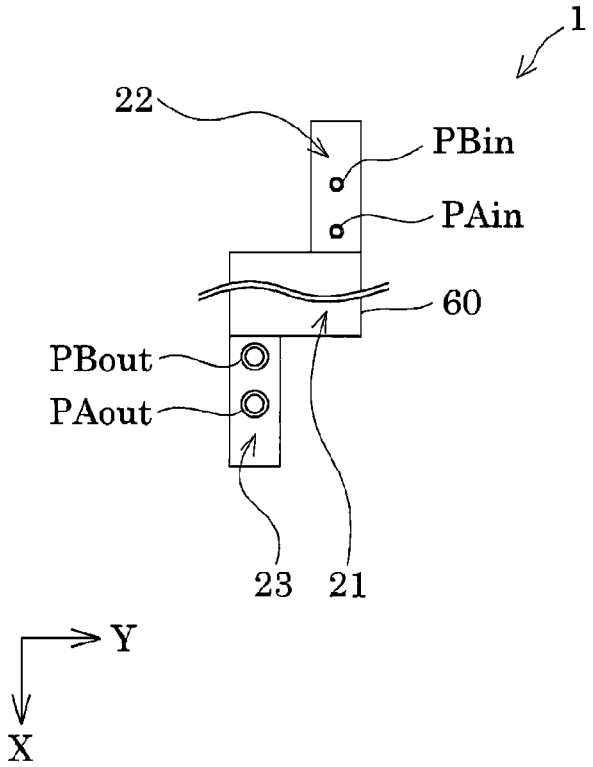
FIG. 18 is a plan view of an essential part of a head unit 1.

Referring to FIG. 18, a modified example of a diameter of the port will be described. FIG. 18 is a plan view of an essential part of the head unit 1 according to a modified example. In the drawing, the cover member 65 is not illustrated, and the same components as those in FIG. 14 are denoted by the same reference numbers.

As shown in the figure, the discharge port PAout and the discharge port PBout have a diameter larger than the supply port PAin and the supply port PBin.

Since the discharge ports have a diameter larger than the supply ports, errors in connection of the supply tubes and the discharge tubes to the ports can be easily prevented from occurring. Further, since the flow path resistance on the discharge side can be reduced, circulation of ink in the circulation head 44 can be facilitated, and thus ink ejection performance can be improved. In addition, during initial filling by which the circulation head 44 is filled with ink if it is not filled with ink, air bubbles in the flow path of the circulation head 44 can be easily discharged.

As shown in FIG. 3, in the head module 100, two head units 1 are arranged in parallel in the X direction. The ports in the two head units are displaced in the X direction. Specifically, the discharge port PAout and the discharge port PBout of the head unit 1 on the +X-axis side are located at positions offset in the X direction from the supply port PAin and the supply port PBin of the head unit 1 on the −X-axis side. For example, the supply port PAin and the supply port PBin of the head unit 1 on the −X-axis side are not positioned on a dotted line H1 and a dotted line H2, respectively, which are the lines perpendicular to the X direction and extending through the discharge port PAout and the discharge port PBout of the head unit 1 on the +X-axis side, respectively.

With this arrangement of the ports, a distance between the port of the head unit 1 on the +X-axis side and the port of the head unit 1 on the −X-axis side can be ensured. Accordingly, attachment and detachment of the tubes to and from the ports are facilitated.

In addition, the ports may not be necessarily positioned offset in the X direction. For example, the discharge port of the head unit 1 on the −X-axis side can be positioned on a dotted line perpendicular to the X direction and extending through the supply port PAin of the head unit 1 on the +X-axis side.

Further, the ports arranged in the X direction in the two head units 1 are arranged in the X direction. The phrase "the ports are arranged in the X direction" means not only a configuration in which all the ports are arranged in the X direction, but also a configuration in which some of the ports are arranged in the X direction.

Specifically, the discharge port PAout and the discharge port PBout of the head unit 1 on the +X-axis side, and the discharge port PAout and the discharge port PBout of the head unit 1 on the −X-axis side are arranged in the X direction (positioned on a dotted line M extending in the X direction). Further, the supply port PAin and the supply port PBin of the head unit 1 on the +X-axis side, and the supply port PAin and the supply port PBin of the head unit 1 on the −X-axis side are arranged in the X direction (positioned on a dotted line N extending in the X direction).

Since the supply ports, which are some of the ports of the two head units 1 are arranged in the X direction, and the discharge ports, which are some of the ports of the two head units 1 are arranged in the X direction. Since the ports are aligned in the X direction, arrangement of the tubes for supplying ink to the ports can be prevented from being complicated. In particular, in this example, the discharge ports are arranged in the dotted line M, and the supply ports are arranged in the dotted line N. Accordingly, the discharge tubes and the supply tubes corresponding to these ports can be neatly arranged without being mixed, and thus work efficiency in attachment and detachment of the tubes is improved.

Further, in the aforementioned embodiment, the supply port and the discharge port are provided as the connecting portion. Since the circulation head 44 in which ink is circulated requires the supply port and the discharge port, the number of ports inevitably increases. However, according to the head unit 1 of the present embodiment, the ports are positioned displaced in the X direction as described above. Accordingly, the width in the Y direction can be reduced and thus the head unit 1 can be reduced in size even if the number of ports increases.

As described above, in the head unit 1 according to the present embodiment, the second flow path portion 22 and the third flow path portion 23 in which the ports are provided are located outside of the first flow path portion 21 in the X direction. Accordingly, compared to a configuration in which a portion in which the port is provided (portion corresponding to the second flow path portion 22 and the third flow path portion 23) is located on the outside of the first flow path portion 21 in the Y direction, a width in the Y direction can be reduced and thus the head unit 1 can be reduced in size. Moreover, the supply port PAin and the supply port PBin are positioned displaced from each other in the X direction, and the discharge port PAout and the discharge port PBout are positioned displaced from each other in the X direction. With this arrangement of the ports, a width of the head unit 1 in the Y direction can be reduced and thus the head unit 1 can be reduced in size.

The head module 100 includes such a small-sized head unit 1. Accordingly, the head module 100 can also be small-sized. In addition, the recording apparatus I including such a head module 100 can also be small-sized.

Other Embodiments

Although the embodiments of the disclosure are described above, the basic configuration of the disclosure is not limited to those described above.

For example, although the apparatus for ejecting ink is described as the circulation head 44, but is not limited to such elements in which ink is circulated. That is, an apparatus configured to allow ink to be supplied from the supply port via the flow path member 60 and ejected through the nozzles N may also be used. In this case, the head unit 1 may be configured to have only the supply port as the connecting portion.

Although two circulation flow paths are provided in one head unit 1, the configuration is not limited thereto, and one circulation flow path or three or more circulation flow paths may also be provided. Further, although four circulation heads 44 are provided in one head unit, any number of the circulation heads may be provided.

Although eight head units 1 in total are provided in the head module 100, any number of the head units may be provided. Further, arrangement of the head units 1 in the head module 100 is not limited.

Although the plurality of circulation heads 44 are arranged in a zig-zag pattern in the X direction in the holder 30, the arrangement is not limited thereto. For example, the circulation heads 44 may also be arranged in parallel in the X direction or the Y direction. Further, the circulation heads 44 may also be arrayed in a matrix in the X direction and the Y direction.

Further, as shown in FIG. 13, the ejection surface 10 has the first portion P1, the second portion P2, and the third portion P3. However, the third portion P3 may not be necessarily be provided. Further, although the second portion P2 and the third portion P3 are provided on both sides of the center line L, they may be provided on the same side of the center line L.

Further, although two ports are provided in each of the second flow path portion 22 and the third flow path portion 23, any number of the ports may be provided. Further, the supply port and the discharge port may be provided in the second flow path portion 22, and the supply port and the discharge port may be provided in the third flow path portion 23.

In the embodiment described above, the recording apparatus I is a serial type recording apparatus, in which the head unit 1 is moved by the transport mechanism 4. However, the disclosure is not limited thereto. For example, the disclosure is also applicable to a line type recording apparatus, in which the head unit 1 is fixed to the recording apparatus I, and printing is performed only by transporting the medium S.

In the above embodiments, the ink jet recording head unit is described as an example of the liquid ejecting head unit, the ink jet head module is described as an example of the liquid ejecting head module, and the recording apparatus is described as an example of the liquid ejecting apparatus. However, the disclosure is broadly directed to liquid ejecting head units, liquid ejecting head modules, and liquid ejecting apparatuses in general, and can also be applied to liquid ejecting head units, liquid ejecting head modules, and liquid ejecting apparatuses configured to eject liquid other than ink. Other liquid ejecting head units include, for example, various types of recording head units used for image recording apparatuses such as printers, color material ejecting head units used for manufacturing color filters for liquid crystal displays and the like, electrode material ejecting head units used for manufacturing electrodes for organic EL displays, FEDs (field emission displays), and the like, and bio-organic material ejecting head units used for manufacturing biochips. The disclosure can also be applied to liquid ejecting head modules and liquid ejecting apparatuses having such liquid ejecting head units.

What is claimed is:

1. A liquid ejecting head unit comprising:

an ejection surface including nozzles for ejecting liquid, the nozzles being arranged in a first direction; and a flow path member including a flow path communicating with the nozzles, wherein the ejection surface has a planar shape including a first portion and a second portion, the first portion and the second portion are arranged in the first direction with respect to each other, the first portion spans across a center line of a rectangle having a minimum area that surrounds the ejection surface, the center line extending parallel to the first direction, the second portion is located adjacent to the first portion in the first direction and shifted away from the center line in a second direction that substantially perpendicular to the first direction, the flow path member includes first connecting ports, at least one of the first connecting ports communicating with the flow path and connecting to an external liquid storage unit, and the first connecting ports overlap the second portion in plan view of the ejection surface and are shifted away from each other in the first direction such that the first connecting ports are not located within the first portion.

2. The liquid ejecting head unit according to claim 1, wherein, the ejection surface includes a third portion that is located adjacent to the first portion in the first direction and that is shifted away from the center line in the second direction, and the first portion is located between the second portion and the third portion.

3. The liquid ejecting head unit according to claim 2, wherein the second portion and the third portion are positioned on opposite sides of the center line in the second direction.

4. The liquid ejecting head unit according to claim 2, wherein, the flow path member includes second connecting ports, at least one of the second connecting ports communicating with the flow path and connecting to an external liquid storage unit, the second connecting ports overlap the third portion in plan view, and the second connecting ports are shifted away from each other in the first direction.

5. The liquid ejecting head unit according to claim 2, wherein, the flow path member includes a second connecting port overlapping the third portion in plan view, and the first connecting port and the second connecting port extend to different heights in a third direction perpendicular to the ejection surface.

6. The liquid ejecting head unit according to claim 4, wherein the flow path member includes supply flow paths for supplying liquid to the nozzles, and discharge flow paths for discharging liquid that is not ejected from the nozzles, the first connecting ports communicate with respective ones of the supply flow paths, and the second connecting ports communicate with respective ones of the discharge flow paths.

7. The liquid ejecting head unit according to claim 1, wherein a connector overlaps in plan view the first portion of the flow path member and is located between the ejection surface and at least part of the first connecting port in a third direction perpendicular to the ejection surface, the connector being connected to a wiring for transmitting and receiving a signal to and from an external control unit.

8. The liquid ejecting head unit according to claim 1, wherein a connector overlaps in plan view the first portion of the flow path member, the connector being connected to a wiring for transmitting and receiving a signal to and from an external control unit, and the first connecting ports are located between the ejection surface and the connector in a third direction perpendicular to the ejection surface.

9. The liquid ejecting head unit according to claim 7, wherein the first connecting ports are provided in a portion of the flow path member that is located between the ejection surface and a portion of the flow path member in which the connector is located in the third direction.

10. The liquid ejecting head unit according to claim 8, wherein the first connecting ports are provided in a portion of the flow path member that is located between the ejection surface and a portion of the flow path member in which the connector is located in the third direction.

11. The liquid ejecting head unit according to claim 1, wherein the first connecting ports are arranged in the first direction.

12. The liquid ejecting head unit according to claim 1, wherein:

the first connecting ports include a first-first connecting port and a second-first connecting port, and the first-first connecting port:

is located closer to the first portion in the first direction than is the second-first connecting port and extends to a greater height in a third direction perpendicular to the ejection surface than does the second-first connecting port.

13. The liquid ejecting head unit according to claim 1, further comprising a head fixation portion fixed to an external support body, wherein the head fixation portion is located between the ejection surface and the first connecting ports in a third direction perpendicular to the ejection surface.

14. The liquid ejecting head unit according to claim 13, wherein the head fixation portion is disposed to the outside of the liquid ejecting head unit in the first direction.

15. The liquid ejecting head unit according to claim 1, wherein the flow path member includes a supply flow path for supplying liquid to the nozzles, and a discharge flow path for discharging liquid that is not ejected from the nozzles, and the first connecting ports include a supply port communicating with the supply flow path and a discharge port communicating with the discharge flow path.

16. The liquid ejecting head unit according to claim 15, wherein the discharge port has a larger diameter than that of the supply port.

17. The liquid ejecting head unit according to claim 3, wherein, the flow path member includes second connecting ports, at least one of the second connecting ports communicating with the flow path and connecting to an external liquid storage unit, the second connecting ports overlap the third portion in plan view, and the second connecting ports are shifted away from each other in the first direction.

18. A liquid ejecting head module comprising:

the liquid ejecting head unit according to claim 17; and a second liquid ejecting head unit according to claim 17, wherein the liquid ejecting head unit and the second liquid ejecting head unit are arranged in parallel in the first direction, at least part of the third portion of the liquid ejecting head unit and at least part of the second portion of the second liquid ejecting head unit overlap in the second direction, and the second connecting ports of the liquid ejecting head unit and the first connecting ports of the second liquid ejecting head unit are shifted away from each other in the first direction.

19. A liquid ejecting head module comprising:

the liquid ejecting head unit according to claim 1; and a second liquid ejecting head unit according to claim 1, wherein the liquid ejecting head unit and the second liquid ejecting head unit are arranged in parallel in the first direction, and the first connecting ports of the liquid ejecting head unit are arranged in the first direction from the first connection ports of the second liquid ejecting head unit.

20. A liquid ejecting apparatus comprising:

the liquid ejecting head unit according to claim 1; and a transport mechanism transporting a medium.

* * * * *